US008127502B2

(12) United States Patent
Hulls et al.

(10) Patent No.: US 8,127,502 B2
(45) Date of Patent: Mar. 6, 2012

(54) BUILDING STRUCTURE CONFIGURED TO EXHIBIT A PRESCRIBED LOAD-DEFLECTION RELATIONSHIP WHEN A FORCE IS APPLIED THERETO

(75) Inventors: John Hulls, Point Reyes, CA (US); Rory R. Davis, Gardnerville, NV (US)

(73) Assignee: EI-Land Corp., La Jolla, CA (US)

( * ) Notice: Subject to any disclaimer, the term of this patent is extended or adjusted under 35 U.S.C. 154(b) by 2103 days.

(21) Appl. No.: 10/637,444

(22) Filed: Aug. 8, 2003

(65) Prior Publication Data

US 2004/0154258 A1 Aug. 12, 2004

Related U.S. Application Data

(63) Continuation-in-part of application No. PCT/US03/03960, filed on Feb. 11, 2003.

(60) Provisional application No. 60/401,839, filed on Aug. 6, 2002.

(51) Int. Cl.
*E04H 14/00* (2006.01)

(52) U.S. Cl. ..... 52/1; 52/167.1; 52/167.8

(58) Field of Classification Search ..... 52/167.8, 52/167.1, 167.7, 1, 167.3, 293.3
See application file for complete search history.

(56) References Cited

U.S. PATENT DOCUMENTS

| | | | | |
|---|---|---|---|---|
| 1,536,717 | A * | 5/1925 | Krekel | 52/657 |
| 2,146,333 | A | 2/1939 | Deming | |
| 3,606,704 | A * | 9/1971 | Denton | 52/167.8 |
| 4,094,111 | A | 6/1978 | Creegan | |
| 4,441,289 | A * | 4/1984 | Ikuo et al. | 52/167.1 |
| 5,177,915 | A | 1/1993 | Kobori et al. | |
| 5,349,794 | A * | 9/1994 | Taga | 52/167.1 |
| 5,433,045 | A * | 7/1995 | Yano et al. | 52/167.4 |
| 5,456,047 | A | 10/1995 | Dorka | |
| 5,462,141 | A * | 10/1995 | Taylor | 188/280 |
| 5,595,040 | A | 1/1997 | Chen | |
| 5,628,156 | A | 5/1997 | Tarics | |
| 5,660,017 | A | 8/1997 | Houghton | |
| 5,680,738 | A | 10/1997 | Allen et al. | |
| 5,706,626 | A | 1/1998 | Mueller | |
| 5,765,313 | A * | 6/1998 | Lee et al. | 52/1 |

(Continued)

FOREIGN PATENT DOCUMENTS

WO 02/090681 A1 11/2002

(Continued)

OTHER PUBLICATIONS

Simpson Strong-Tie Co., Inc.,"Wood Construction Connectors," Catalog C-2002 Front Cover and p. 31.

(Continued)

*Primary Examiner* — Basil Katcheves
(74) *Attorney, Agent, or Firm* — Drinker Biddle & Reath LLP

(57) ABSTRACT

A structure, including: at least two structural members; a joining element connected to the at least two structural members; and at least one active element within the joining element, or between the joining element and at least one of the structural members, wherein a force applied to one structural member passes at least partially through the active element and into the other structural member, the active element being configured such that the structure exhibits a prescribed load-deflection relationship when a force is applied thereto.

76 Claims, 27 Drawing Sheets

U.S. PATENT DOCUMENTS

| | | | | |
|---|---|---|---|---|
| 5,850,043 | A * | 12/1998 | Robinett | 73/786 |
| 5,870,863 | A * | 2/1999 | Taylor | 52/167.3 |
| 5,875,589 | A | 3/1999 | Lai et al. | |
| 5,904,025 | A | 5/1999 | Bass et al. | |
| 5,927,019 | A | 7/1999 | Ichida | |
| 5,934,028 | A * | 8/1999 | Taylor | 52/167.3 |
| 6,006,487 | A | 12/1999 | Leek | |
| 6,112,799 | A | 9/2000 | Mullet et al. | |
| 6,148,583 | A | 11/2000 | Hardy | |
| 6,170,202 | B1 | 1/2001 | Davoodi et al. | |
| 6,212,849 | B1 | 4/2001 | Pellock | |
| 6,233,884 | B1 | 5/2001 | Tipping et al. | |
| 6,237,303 | B1 | 5/2001 | Allen et al. | |
| 6,293,063 | B2 | 9/2001 | Van Doren | |
| 6,308,469 | B1 | 10/2001 | Leung | |
| 6,327,825 | B1 | 12/2001 | Sanders et al. | |
| 6,389,767 | B1 | 5/2002 | Lucey et al. | |
| 6,412,237 | B1 | 7/2002 | Sahai | |
| 6,438,905 | B2 | 8/2002 | Constantinou | |
| 6,481,175 | B2 | 11/2002 | Potter et al. | |
| 6,560,940 | B2 | 5/2003 | Mueller | |
| 6,672,573 | B2 * | 1/2004 | Berton | 267/136 |
| 6,761,001 | B2 | 7/2004 | Mueller | |
| 2001/0002529 | A1 | 6/2001 | Commins et al. | |
| 2002/0020122 | A1 | 2/2002 | Mueller | |
| 2002/0162284 | A1 | 11/2002 | Karalic | |
| 2002/0162285 | A1 | 11/2002 | Sahai | |

FOREIGN PATENT DOCUMENTS

| | | | |
|---|---|---|---|
| WO | WO 02/090681 | A1 | 11/2002 |

OTHER PUBLICATIONS

"Details, Dimensions and How to do it!," Installation Manual, Simplified Structural Systems, Copyright 2000.

Smith, Peter R., "DESC 1004 Building Principles", University of Sydney, 8 pages (Sep. 2, 2000).

Davis, Gil, "Steel moment-frame buildings", Strcutural Engineer, pp. 28-35 (Jun. 2001).

Utterback, David, "Common Engineering Problems in Fram Construction", http://www.taunton.com/pages/h00011.asp, The Taunton Press, 6 pages (Apr. 3, 2002).

* cited by examiner

BUILDING STRUCTURE CONFIGURED TO EXHIBIT A PRESCRIBED LOAD-DEFLECTION RELATIONSHIP WHEN A FORCE IS APPLIED THERETO

This application is a Continuation-in-Part of International Patent Application No. PCT/US03/03960 filed on Feb. 11, 2003, which claims priority to both U.S. application Ser. No. 10/074,684 filed on Feb. 11, 2002, and U.S. Provisional Application No. 60/401,839 filed on Aug. 6, 2002; the entire contents of which are hereby incorporated by reference.

TECHNICAL FIELD

The present invention relates generally to structures used in buildings, and in particular to structures used to reinforce building walls and portal openings.

BACKGROUND OF THE INVENTION

The construction industry is increasing its focus on the survivability of buildings under extreme loads from seismic events and other forces, and modern codes are increasingly focusing on the ability of the components of the buildings to resist the loads of earthquakes, while not only withstanding and transmitting the loads, but also absorbing and dissipating such loads.

Various systems have been used to reinforce building portal openings and building walls include moment frames, systems having springs, electro-mechanical damping and building isolation systems.

For example, the Simpson StrongWall® is a system typically used for reinforcing walls and portal openings in a building. It is a pre-build shear wall that may be incorporated into a building structure. Preferably, two such StrongWalls® are used, with a StrongWall® positioned on either side of the portal opening. A header beam is connected to the top ends of these two StrongWalls®. Unfortunately, the Simpson StrongWall® system has a number of disadvantages, including the fact that it must resist strong overturning moments due to its high height to width ratio. In addition, the StrongWall® system requires a variety of connectors and it incorporates a number of internal reinforcements, making it a complex and bulky system.

A typical reinforced brace frame is also made by Hardy Industries of Ventura Calif. The Hardy Frame® is a metal frame equivalent of the Simpson Strong Wall® factory-build wooden shear wall. The Hardy Frame® specifically includes a diagonal member with spaced vertical support members to provide increased resistance against simultaneous shear stress and uplifting.

As will be explained, the present invention is capable of simultaneously performing all of the functions required by the present codes, but also the energy dissipation required for better building survival, as projected in proposed codes currently under development such as AR215.

SUMMARY OF THE INVENTION

In preferred aspects, the present invention provides a structure, comprising: at least two structural members; a joining element connected to the at least two structural members; and at least one active element within the joining element, or between the joining element and at least one of the structural members, wherein a force applied to one structural member passes at least partially through the active element and into the other structural member, the active element being configured such that the structure exhibits a prescribed load-deflection relationship when a force is applied thereto. In preferred aspects, the active element is designed (i.e. configured) by performing finite element analysis or iterative calculations.

In a preferred aspect, the present invention is incorporated into a building such that the entire building structure exhibits a desired load-deflection relationship when a force is applied to the building. Thus, by selectively configuring the active element, the present invention may advantageously be used to "tune" the overall structure of the building to optimally absorb, transmit and dissipate energy (including energy from seismic loading). As will be shown, this may be accomplished whether the building is subjected to shear forces alone, or to shear and bending forces together.

In preferred aspects, the joining element of the structure further comprises a connector that is configured to connect at least one of the structural members to an external body such as a fixed wall base or a ground plane member in any story of a building. In preferred aspects, the connector is configured such that it does not transmit substantial bending moments to the external body in the plane in which the structural members are disposed. As understood herein, a "fixed wall base" may be any structural foundation supporting a wall. As also understood herein, a "ground plane member in any story of a building" may be any floor or foundation member in any story of a building. In optional preferred aspects, the connector may comprise a pivot or a live hinge.

In optional aspects, one of the structural members may be incorporated into the joining element itself. Moreover, in various preferred aspects, the active element may be integrally formed into the joining element itself.

In accordance with the present invention, the structural members and the joining element are stiff enough to cause deformation or deflection of the active elements. In this way, the active elements are effectively part of the overall structure, and are thus part of the load path of the structure.

In preferred aspects, the present invention is configured to be disposed within a wall (including a load bearing wall) so as to reinforce the wall. In this case, the active element is configured such that the wall exhibits a desired load-deflection relationship when a force is applied to the wall.

In preferred aspects, the present invention is configured to be disposed adjacent to a portal opening in a building so as to reinforce the portal opening. In this case, the active element is configured such that structural members adjacent to the portal opening exhibit desired load-deflection relationships when a force is applied to the structural members adjacent to the portal opening. As understood herein, a structural member being "adjacent to" the portal opening includes a structural member at or near the portal opening, including a structural member disposed about the perimeter or at the edges of the portal opening. In optional preferred aspects, the portal opening may be a door, a garage door, a window or a security panel.

In preferred aspects, the active element is preferably configured to transmit, absorb and dissipate energy due to the active element exhibiting a prescribed force/deflection relationship when subject to cyclic motion. In specific preferred aspects, the active element is configured to react to bending moments between the first and second structural members so as to reduce the effects of the bending moment in the plane in which both the first and second structural members are disposed. As will be explained, this is preferably accomplished by reducing the effective length of the bending moment arm of the vertical structural member.

In preferred aspects, the unwanted effects of the bending moment are reduced in the plane in which the first and second structural members are disposed, but are not reduced in a plane other than the plane in which the effects of the bending moment are reduced (e.g.: a plane perpendicular to the plane in which the first and second structural members are disposed). This is preferably accomplished by allowing relative movement between the structural members in only one plane. Most preferably, such relative movement is only permitted in the plane in which the structural members are disposed (or a plane parallel thereto). For example, the plane in which relative movement between the structural members is permitted preferably corresponds to the plane of a wall or portal opening in (or around which) the structural members are disposed.

As such, the plane in which the unwanted effects of the bending moment are reduced may variously be the plane of a wall when both structural members are disposed within or on the wall; the plane of a portal opening when both structural members are disposed in the plane of the portal opening; or a vertical plane in which a foundation post and a section of a rim joist are disposed. In preferred aspects, the active element flexes when a force passes therethrough. The degree to which the active element flexes may preferably vary along a length of the active element. In preferred aspects, the load-deflection relationship of the active element is nonlinear, such that the load-deflection relationship of the overall structure is nonlinear. Moreover, in preferred aspects, the load-deflection relationship of the active element in the structure changes the deflection, velocity or acceleration level of the structure in a prescribed manner in response to an applied load.

In preferred aspects, the active element is configured to provide stiffness and energy dissipation by transmitting a force through the structure in a prescribed way. In further optional aspects, such stiffness and energy dissipation may further be effected passively or controlled mechanically or electrically.

In one preferred aspect of the invention, the active element is configured such that the first and second structural members rotate relative to each other about an axis that is displaced from the locus of the joint formed between the first and second structural members. Accordingly, stresses between the first and second structural members do not concentrate at the locus of the joint.

In another preferred aspect of the invention, a pivot may be provided on the joining element such that the axis of rotation of the structural members passes through the pivot. In this aspect, the active element is configured to transmit forces therethrough such that the full stresses between the first and second structural members do not concentrate at the locus of the joint, but are instead shared by the active element.

In optional aspects, a load bearing element that at least partially supports the weight of one of the two structural members is included. Such optional load bearing element ensures that the weight of the one of the two structural members is not fully supported by the active element itself. The load bearing element may optionally comprise a cable or pivot connecting the joining element to one of the structural members.

In preferred aspects, the first structural member is generally vertical. In preferred aspects, the first structural member may include (but is not limited to): a post or a structural member attached to a post; a column, or a structural member attached to a column; a beam, or a structural member attached to a beam; a wall stud, or a structural member attached to a wall stud. Optionally, the first structural member may be intermediate load bearing posts in the wall that are isolated from the wall via vertically extending apertures in the wall.

In preferred aspects, the second structural member is generally horizontal. In preferred aspects, the second structural member may include (but is not limited to): a beam, or a structural member attached to a beam; a wall horizontal plate, or a structural member attached to a wall horizontal plate; a wall sill plate, or a structural member attached to a wall sill plate; a wall header, or a structural member attached to a wall header; a building perimeter frame, or a structural member attached to a building perimeter frame; a rim joist system, or a structural member attached to a rim joist system.

The active elements of the present invention may take a variety of forms. In one exemplary embodiment, the active element comprises a member having a plurality of cut-out sections therein. In this embodiment, the first structural member may be connected to a first portion of the active element and the second structural member may be connected to a second portion of the active element, wherein the cut-out sections permit the first and second portions of the active element to move with respect to one another when the active element flexes. The active element may be configured to first deform elastically and then plastically, or to deform plastically and then elastically.

In an alternate embodiment, the active element comprises a bendable folded length or channel of material. Preferably, the bendable material is metal. In one preferred embodiment, the bendable folded channel of material is dimensioned to flex such that a fold therein spreads apart at one end and is compressed together at an opposite end, permitting the first and second portions of the joining element to rotate relative to one another. In particular embodiments, this active element may optionally comprise a hollow rectangular or channel shaped element having a plurality of slots disposed therealong. For example, the active element may optionally comprise a slotted metal wall stud. In another particular embodiment, the active element comprises a hollow cylinder configured to transmit larger forces (by resisting relative movement) in a direction along the axis of the cylinder, while transmitting much smaller forces (by permitting relative movement) in a direction normal to the axis of the cylinder. Other element configurations that similarly have high stiffness in selected directions and low stiffness in other selected directions are usable.

DEFINITIONS

Figure 1:
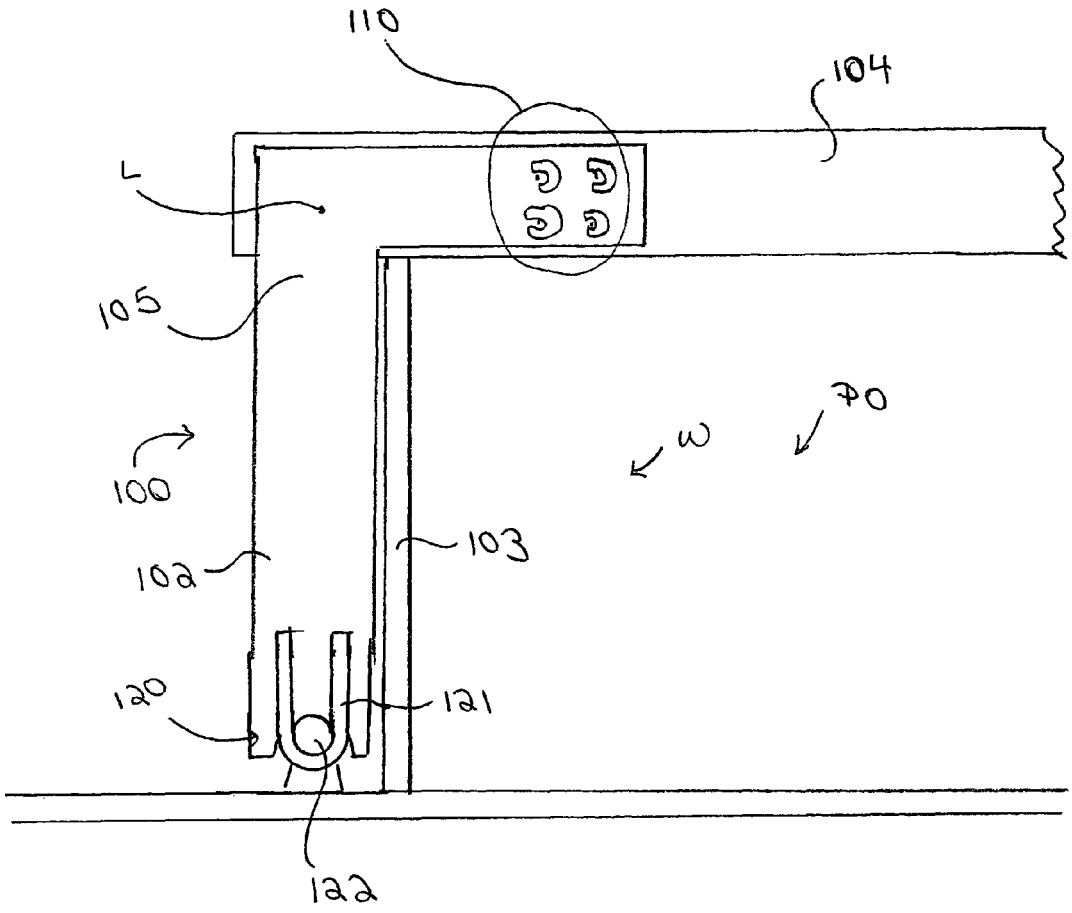
FIG. 1 is a side elevation view of a first embodiment of the present invention.

As used herein the following terms are to be understood to be defined as described below.

"Transmit" shall be understood to define the capacity of an element to withstand applied forces and to react them from one location to another, according to the laws of mechanics, specifically force equilibrium. Transmission of forces of an element within a system always depends on its geometric configuration and its strength capacity relative to the force magnitude to be transmitted, and in some instances on its stiffness.

"Load path" shall be understood to define a route for load to be transmitted.

"Dissipation" shall be understood to define a process of conversion of energy from an undesirable motion form permanently and irreversibly to a benign form, which as one example involves converting mechanical work energy (force acting over a distance) into plastic strain energy of a material, and subsequently heat energy. Dissipation is effected by mechanical damping and plasticity, and can be used to reduce maximum deflection of structures subjected to external forces.

"Absorption" shall be understood to define a process of conversion of energy from an undesirable motion form reversibly and temporarily to a benign form, which as one example involves converting mechanical work energy (force acting over a distance) into elastic strain energy of a material, which can be later restored. Such absorption is effected by mechanical stiffness or springs, and can be used to reduce maximum deflection of structures subjected to external forces.

"Shear wall" shall be understood to define a structure capable of resisting shear forces, the shear wall being constructed of framing members having a sheathing material disposed thereon. The framing members may be constructed of wood, metal or similar materials.

"Active element" shall be understood to define a load-bearing element with defined load versus deflection properties that may be designed by engineering analysis in one or more directions or degrees of freedom. The active element is a device configured to deflect or distort in a prescribed manner under load.

"Finite element analysis" shall be understood to include the use of a computer model based on the finite element mathematical method to predict reaction forces, deformations, stresses, and strains of a structure in response to applied forces or enforced displacements.

DETAILED DESCRIPTION OF THE DRAWINGS

The present invention provides a very versatile system for structural reinforcement; including, but not limited to reinforcing building structures, including walls and portal openings. As will be explained, the present invention can advantageously be used to reinforce building structures against seismic loading. However, the present invention is not so limited. For example, the present invention can also be used to provide reinforcement around a portal opening in a building (such as a door, garage door or window frame) so that the typical unwanted effects of a portal opening can be substantially reduced. Such typical unwanted effects of a portal opening include its reducing the structure's overall resistance to shear, and the increased stress concentrations that occur at the corners of the portal. Additional unwanted effects of portal openings include the high overturning moments they create in high-aspect walls (such as the Simpson StrongWall® made by Simpson Strong-Tie Company, Inc., of Dublin, Calif.).

As will be explained, the present invention can be used to substantially reduce the unwanted effects of bending moments in building structures, and to reduce stress concentrations in building corners (such as the locus of joints formed between various building structural members).

Figure 15:
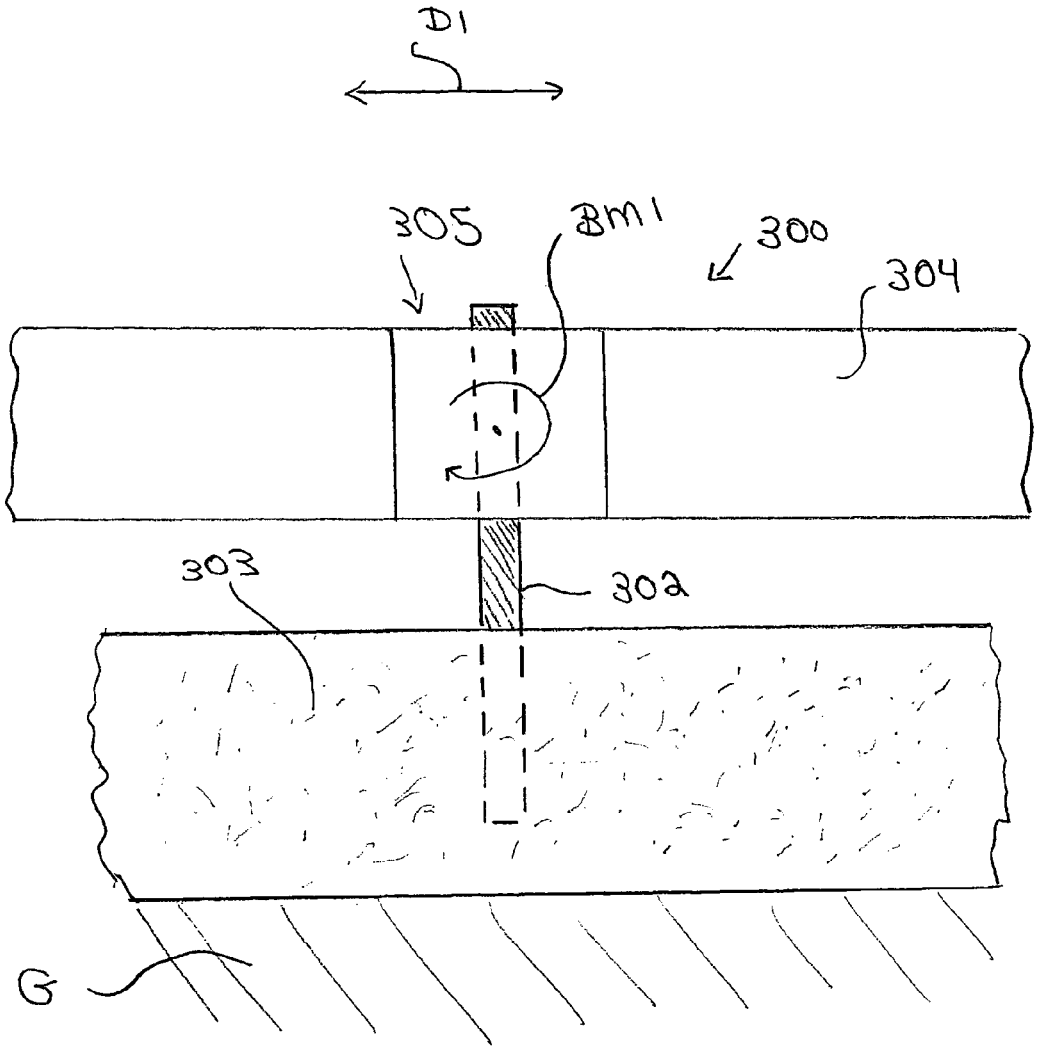
FIG. 15 is a side elevation view of a third embodiment of the present invention.
Figure 16:
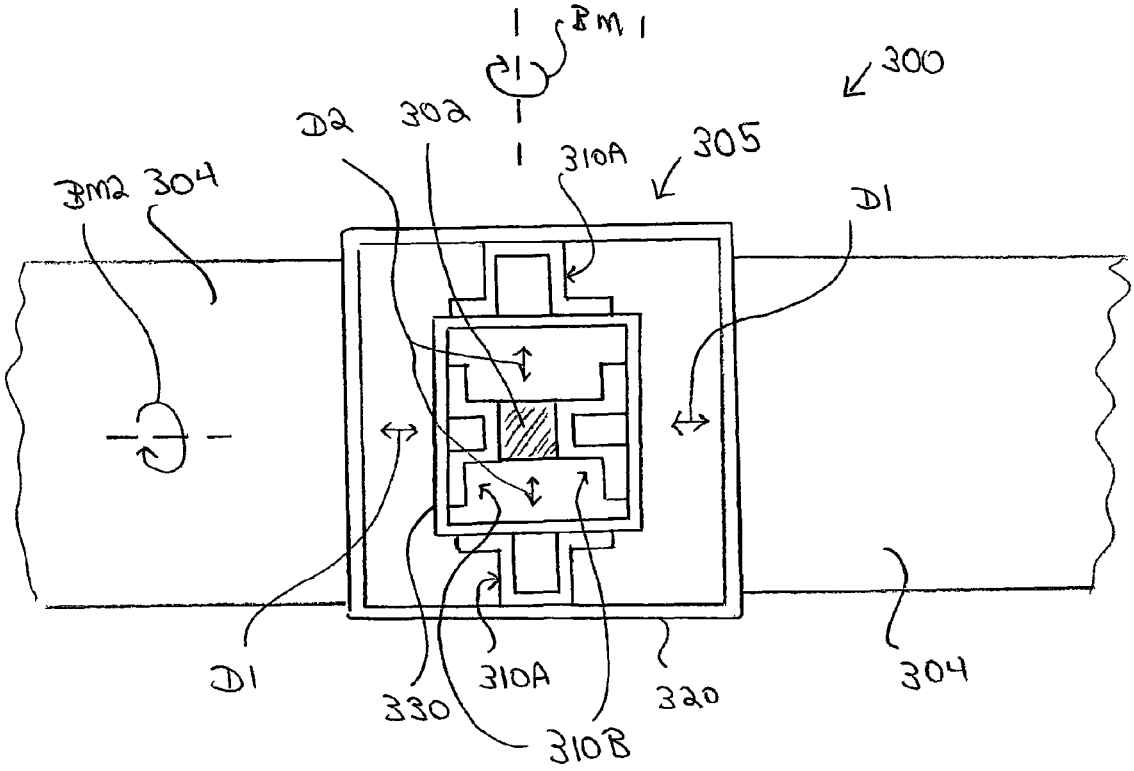
FIG. 16 is a top plan view of the third embodiment of the present invention.
Figure 17:
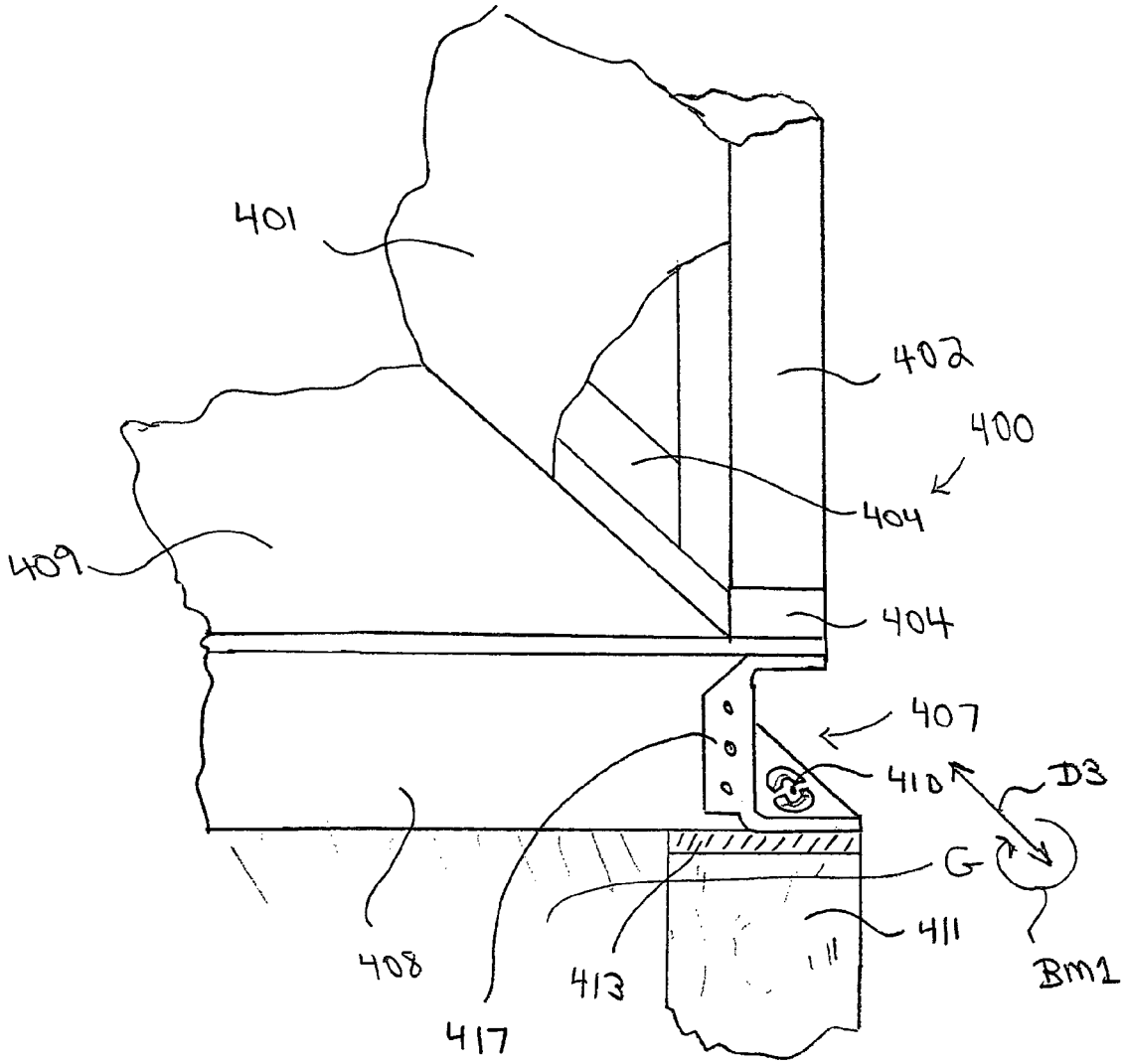
FIG. 17 is a perspective view of a wall stud and sill plate sitting on a floor joist and foundation, incorporating a joist hanger according to the present invention.
Figure 18:
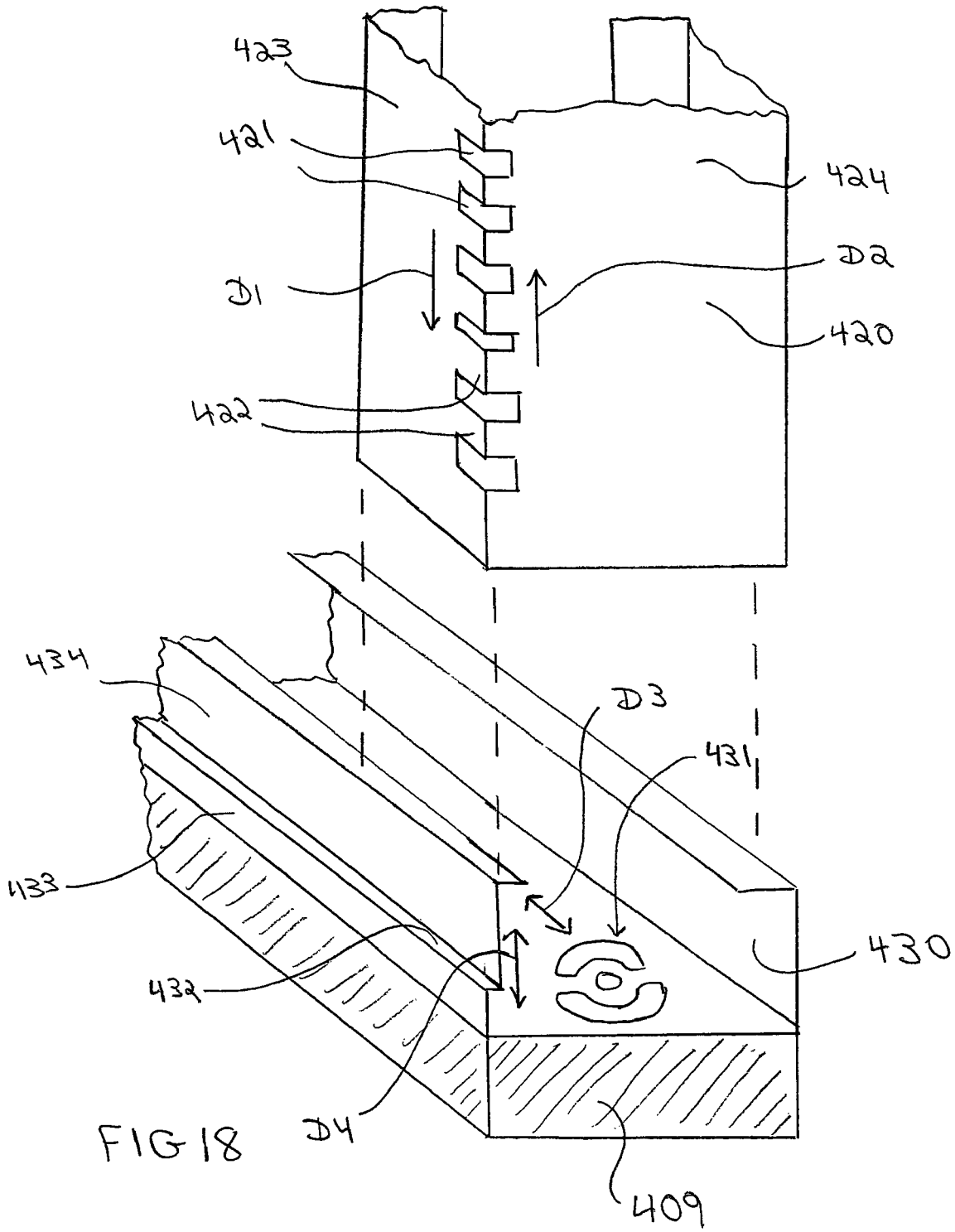
FIG. 18 is a perspective view similar to FIG. 17, incorporating a wall stud and sill plate according to the present invention.
Figure 24:
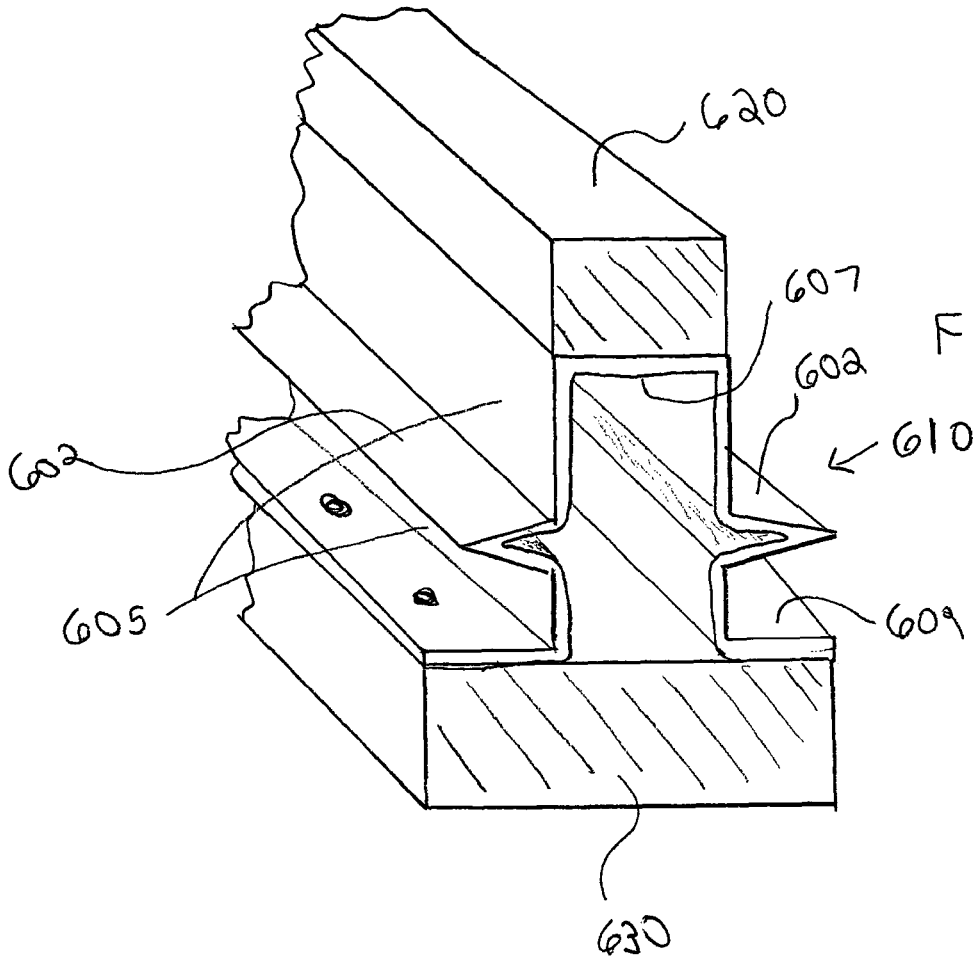
FIG. 24 is a perspective view of an alternate active element of the present invention.
Figure 25:
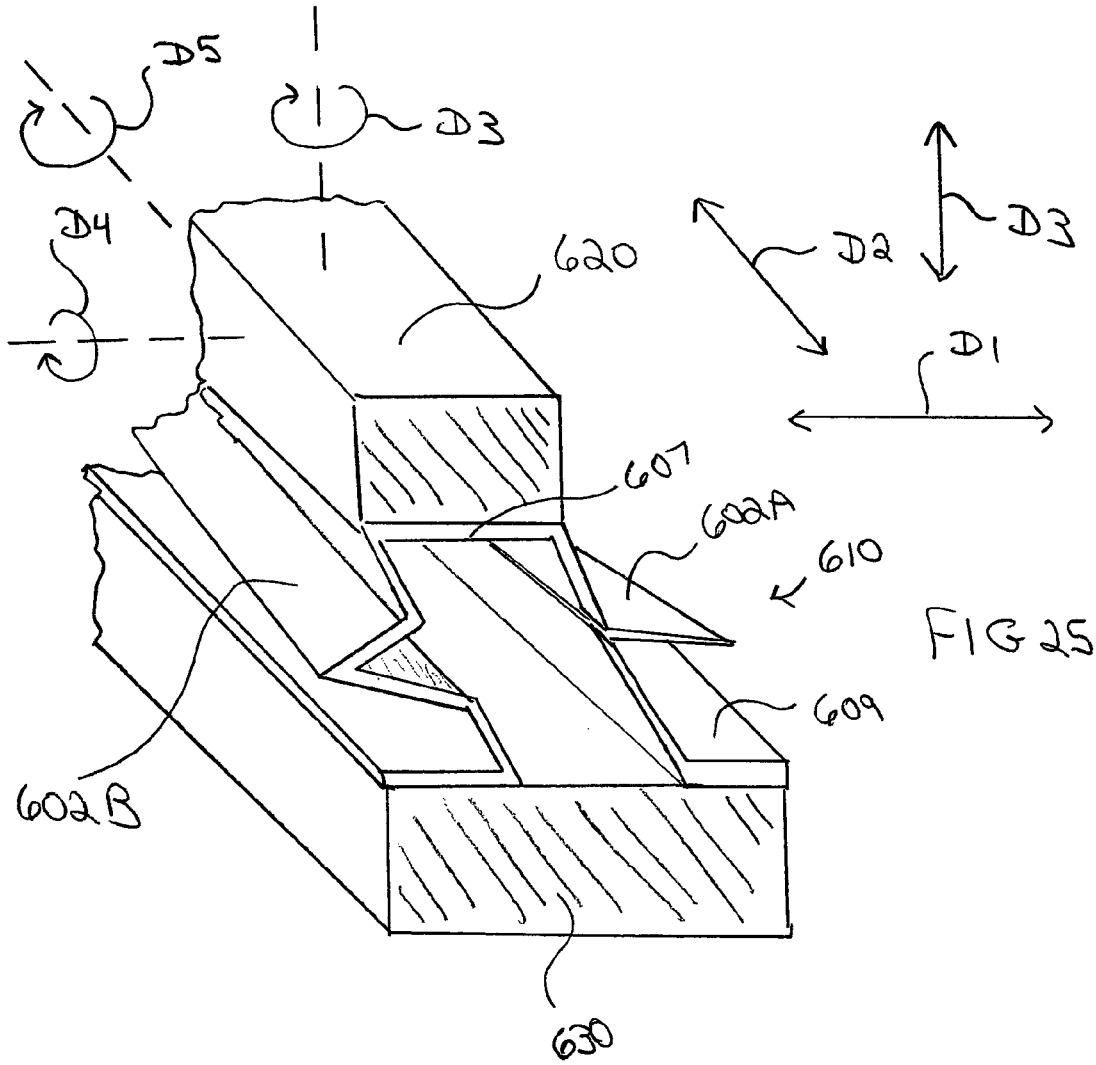
FIG. 25 is a perspective view of the active element of FIG. 24 after it has been deflected by a force applied thereto.
Figure 26:
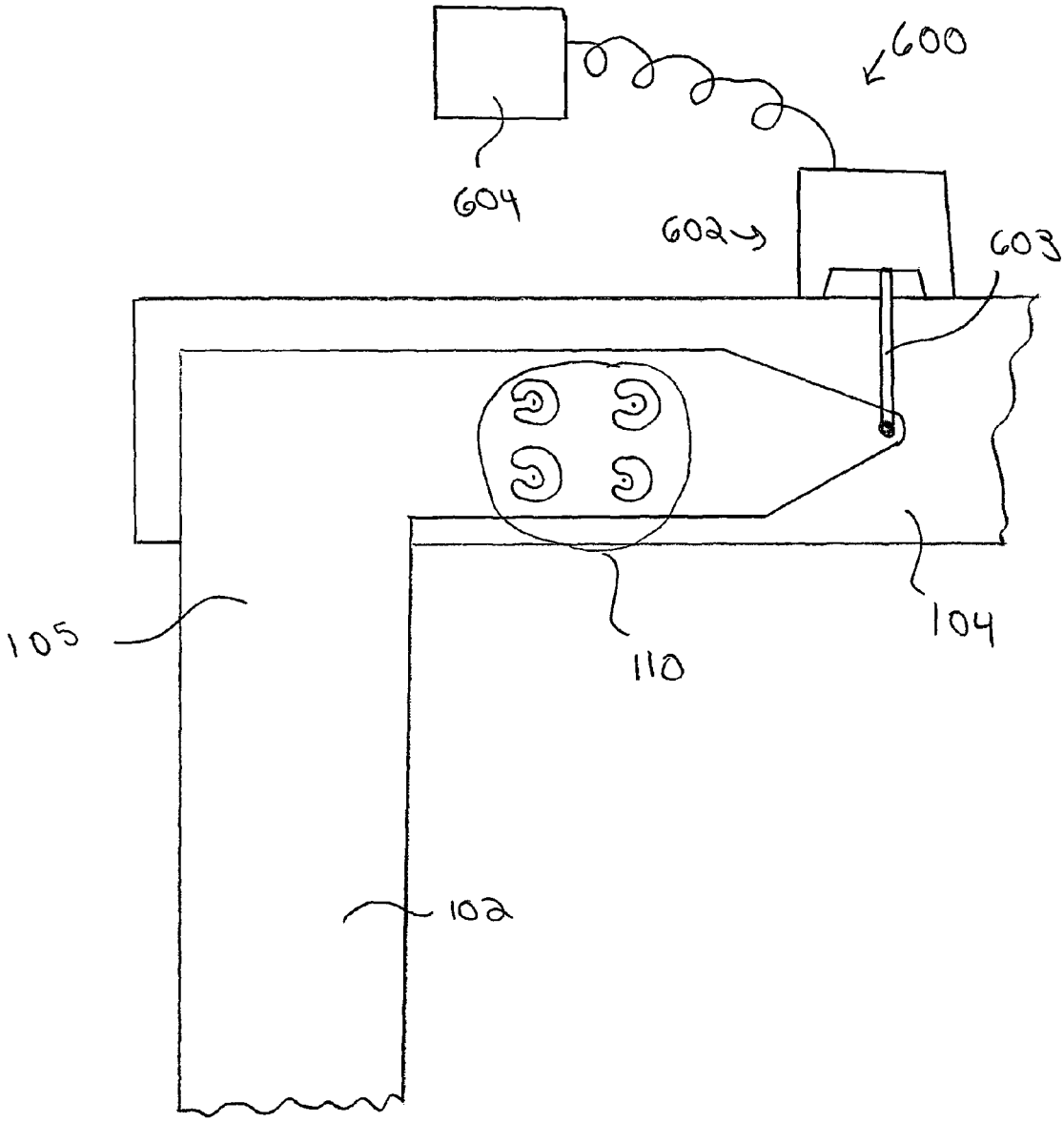
FIG. 26 is a side elevation view of the first embodiment of the invention further including an optional add-on electromechanical system for passively or actively controlling stiffness and energy dissipation.
Figure 27:
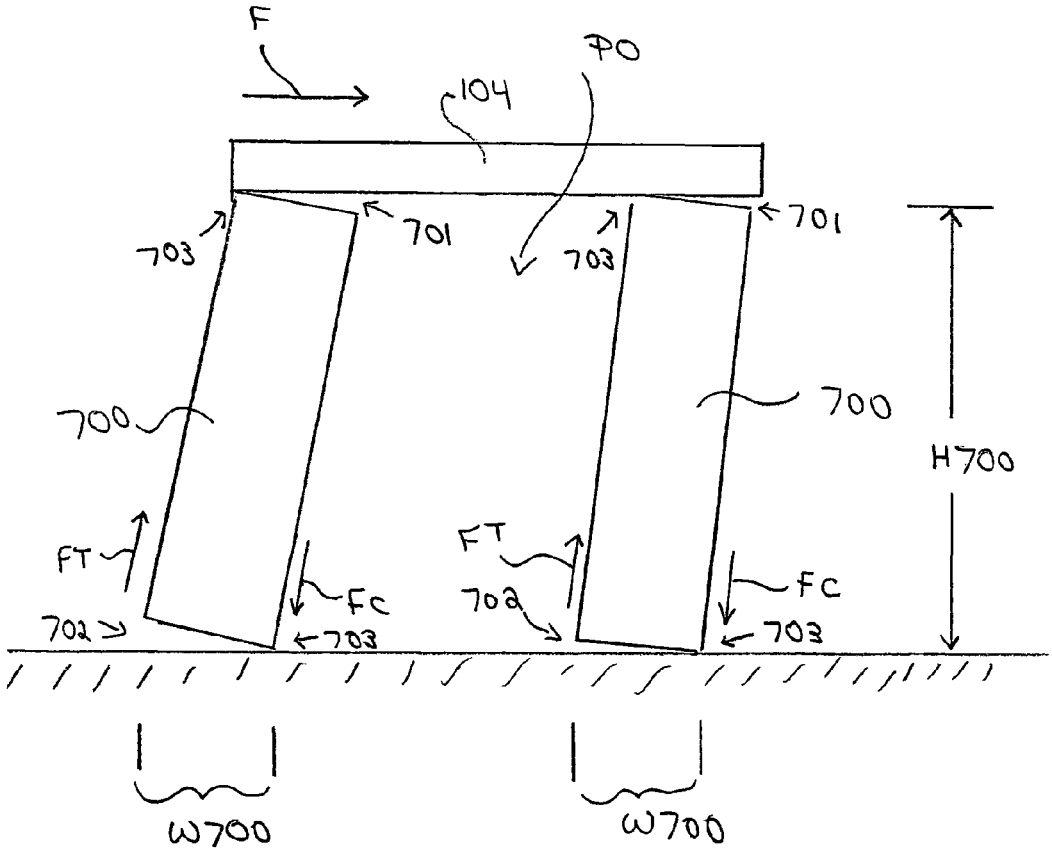
FIG. 27 is a side elevation view of a pair of Simpson StrongWalls® disposed on either side of a portal opening.
Figure 28:
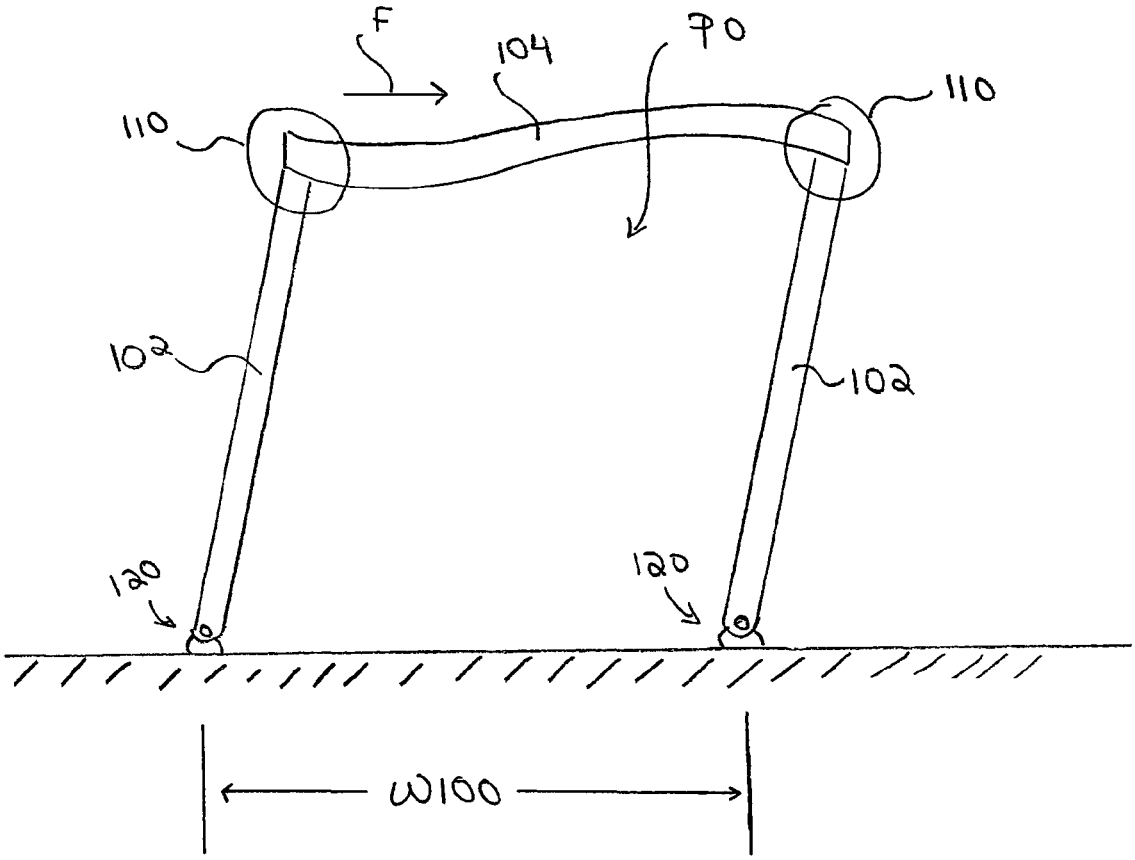
FIG. 28 is a side elevation view of a system of structural members according to the present invention, with a pair of vertical structural members disposed on either side of a portal opening.

FIGS. 1 to 6 show a first embodiment of the invention. FIGS. 7 to 14 show a second embodiment of ne invention. FIGS. 15 and 16 show a third embodiment of the invention. FIGS. 17 and 18 illustrate a particular cases of a rim joist, wall stud and sill plate according to the present invention. FIGS. 19 to 23 show a fourth embodiment of the invention. FIGS. 24 and 25 illustrate an alternative active element design according to the present invention. FIG. 26 illustrates an optional add-on system for passively or actively controlling stiffness and energy dissipation. FIGS. 27 and 28 illustrate advantages of the present system as compared to a Simpson StrongWall® portal reinforcing system.

FIGS. 1 to 6:

FIGS. 1 to 6 illustrate a first embodiment of the present invention, as follows. Referring first to FIG. 1, a structure 100 is provided. Structure 100 includes at least two structural members. In one aspect, the first structural member is a vertically extending member 102, and the second structural member is a header beam 104. Optionally, the first structural member may instead comprise a vertical post or beam 103. It is to be understood that vertically extending member 102 may optionally be attached to beam 103 such that member 102 and beam 103 together comprise the first structural member. It is also to be understood that beam 103 may be omitted such that vertically extending member 102 alone comprises the first structural member. Point "L" illustrates the locus of the joint formed between structural members 102 and 104. Header beam 104 may be made of wood, laminated veneer lumber (lvl), pressed steel or any other suitable structural material to which joining element 105 may be attached.

Structure 100 includes a joining element 105 that is connected to the at least two structural members 102 (or 102/103 together) and 104. As illustrated, joining element 105 may simply be incorporated (e.g. integrally formed with) structural member 102.

An active element 110 is provided. Active element 110 may be integrally formed into joining element 105, as shown (such that joining element 105 is L-shaped). As such, active element 110 is disposed between joining element 105 and at least one of the structural members (header beam 104).

Active element 110 is configured such that when a force applied to one structural member (e.g. to header beam 104) the force passes at least partially through active element 110 and into the other structural member (e.g. vertical member 102), such that the entire structure 100 exhibits a prescribed load-deflection relationship.

A connector 120 configured to connect vertical member 102 to an external body is provided. As shown, connector 120 may comprise a U-shaped bracket 121 that freely rotates around a pin joint 122. (U-shaped bracket 121 being attached to vertical member 102). Alternatively, connector 120 may comprise a live hinge joint (i.e. a bendable flange of material).

In various aspects, structure 100 may alternatively be disposed adjacent to (or fully within) a wall W or portal opening PO. For this reason, FIG. 1 illustrates both a wall W and a portal opening PO. It is to be understood that either may be provided within the space labeled as "W" or "PO". Wall W may be any load bearing wall, or any part thereof. Therefore, when disposed either within or adjacent to a wall W, structure 100 may be used to reinforce the wall. In preferred aspects, portal opening PO may include a door, a garage door, a window or a security panel. When disposed adjacent to (i.e. at, near or around) portal opening PO, structure 100 may be used to reinforce the portal opening.

Figure 2:
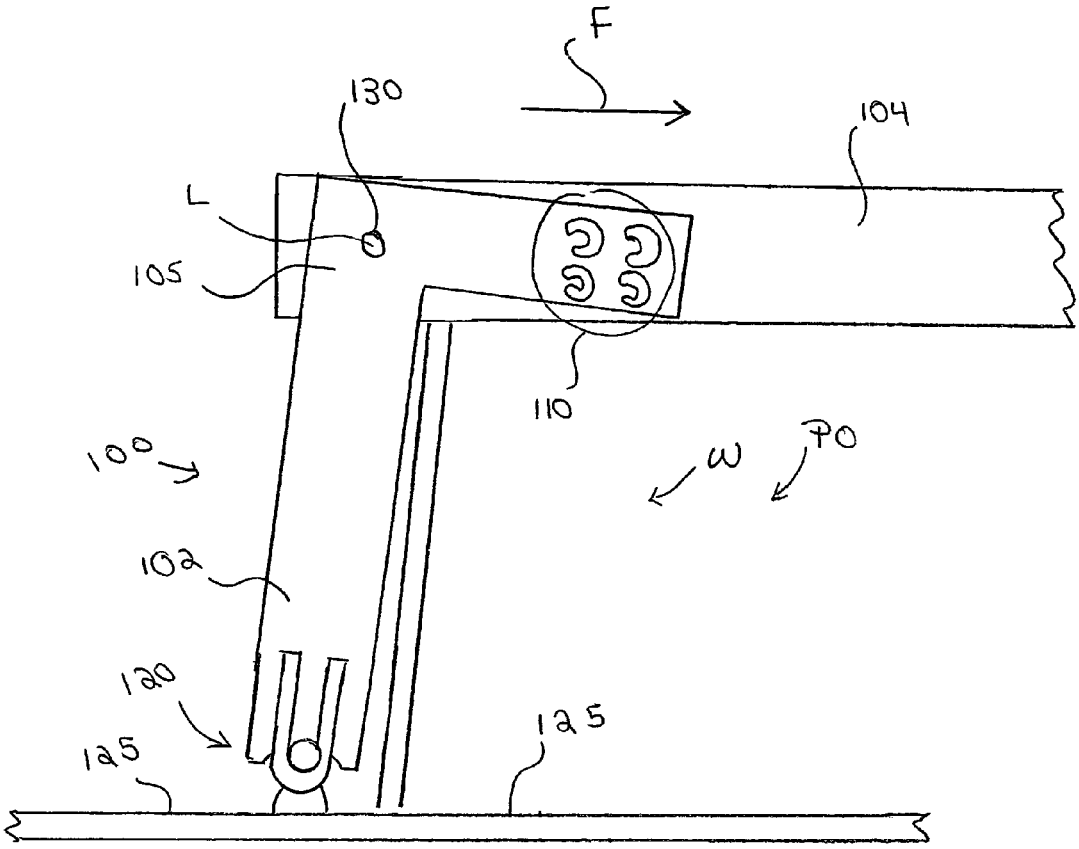
FIG. 2 is a side elevation view of the first embodiment of the invention, further including a pivot joint between the structural members, showing movement of the structural members of the system when a force has been applied thereto.

Referring next to FIG. 2, connector 120 is configured such that when a force F is applied to header beam 104, U-shaped bracket 121 will rotate slightly around pin joint 122. In this way, connector 120 permits movement of structural members 102 and 104 without transmitting substantial bending moments to an external body 125. (External body 125 may comprise a portion of any floor of a building or the foundation of the building.) Specifically, structural members 102 and 104 are permitted to rotate relative to one another while connector 120 prevents, or very substantially reduces, bending moment transmission to floor/foundation 125 in the plane in which structural members 102 and 104 are disposed.

For example, when structural members 102 and 104 are disposed within a wall of a building, connector 120 prevents bending moment transmission to the floor/foundation 125 in the plane of the wall. Alternatively, when structural members 102 and 104 are disposed around the perimeter of a portal opening (such as a door, a garage door or a window opening), connector 120 prevents bending moment transmission to the floor/foundation 125 in the plane of the portal opening.

An advantage of connector 120 is that it is preferably configured to transmit bending moments to floor/foundation 125 in a plane or direction normal to the wall. This is because connector 120, as shown, is not configured to rotate in a direction normal to the plane of the wall or portal opening. This is particularly advantageous in that the overall structure retains its stiffness in a direction normal to the wall, and is thus able to withstand wind loading against the wall.

Whereas floor/foundation 125 may be a first floor foundation, it is to be understood that element 125 may alternatively represent a ground plane or floor member found on any story of a building. Thus, the present invention is not limited to reducing the unwanted effects of bending moments at the base of a building. Rather, it may be used to reduce the unwanted effects of concentrated overturning moments between various stories of a building (as is found when using the Simpson StrongWall® or Hardy Frame® designs on various stories of a building).

Active element 110 is preferably configured such that wall W (or structural members adjacent to the portal opening PO) exhibit a desired load-deflection relationship when a force is applied to the load bearing wall. When structure 100 is disposed within a building, active element 110 is preferably configured such that the entire building exhibits a desired load-deflection relationship when a force is applied to the building.

Active element 110 is preferably configured to transmit, absorb and dissipate energy due to structure 100 exhibiting a prescribed force/deflection relationship when subject to a force such as through cyclic motion. Accordingly, active element 110 is preferably configured to react to a bending moment between members 102 and 104 in the plane in which both the first and second structural members are disposed such that the unwanted effects of bending moments between structural members 102 and 104 are substantially reduced. Specifically, active element 110 reacts by transmitting, absorbing and dissipating energy resulting from the relative motion of the first and second structural members 102 and 104.

Active element 110 is preferably designed by performing finite element analysis, or iterative calculations. For example, active element 110 (or any other active element described herein) are preferably designed by a finite element analysis computer program capable of iterative calculations to optimize the performance of the active element. An example of such a program is ANSYS, available from ANSYS, Inc., of Houston, Pa.

As can be seen, active element 110 may optionally be integrally formed into joining element 105. As will be explained, this can be accomplished by designing active element 110 as a series of cut out sections.

As can be seen in FIG. 2, an optional pivot 130 can be provided between header beam 104 and joining element 105/vertical member 102. Pivot 130 may preferably be positioned at the locus L of the joint between structural members 102 and 104, as shown. When a force F is applied along header beam 104, header beam 104 and vertical member 102 will rotate relative to each other about pivot 130. Pivot 130 may optionally be connected to wall W (when wall W covers structure 100). A variety of different connector systems may be used to connect the wall to the pivot.

As will be explained below, active element 110 will preferably flex when this rotation occurs. By flexing, active element 110 operates so that stresses between structural members 102 and 104 do not concentrate between the structural members at the joint locus L. Instead, the stresses are shared by active element 110 flexing. Moreover, pivot 130 also assists in providing support to horizontal header beam 104. In this aspect of the invention, active element 110 is positioned some distance away from the joint locus L between structural members 102 and 104. In the case of a plurality of active elements being used, the active elements are preferably distributed at different locations away from joint locus L, as shown. This allows multiple active elements to be incorporated into a structure over a large area to thereby reduce loads on individual active elements and their attachments, while providing desired force/deflection properties to the overall structure.

Figure 3:
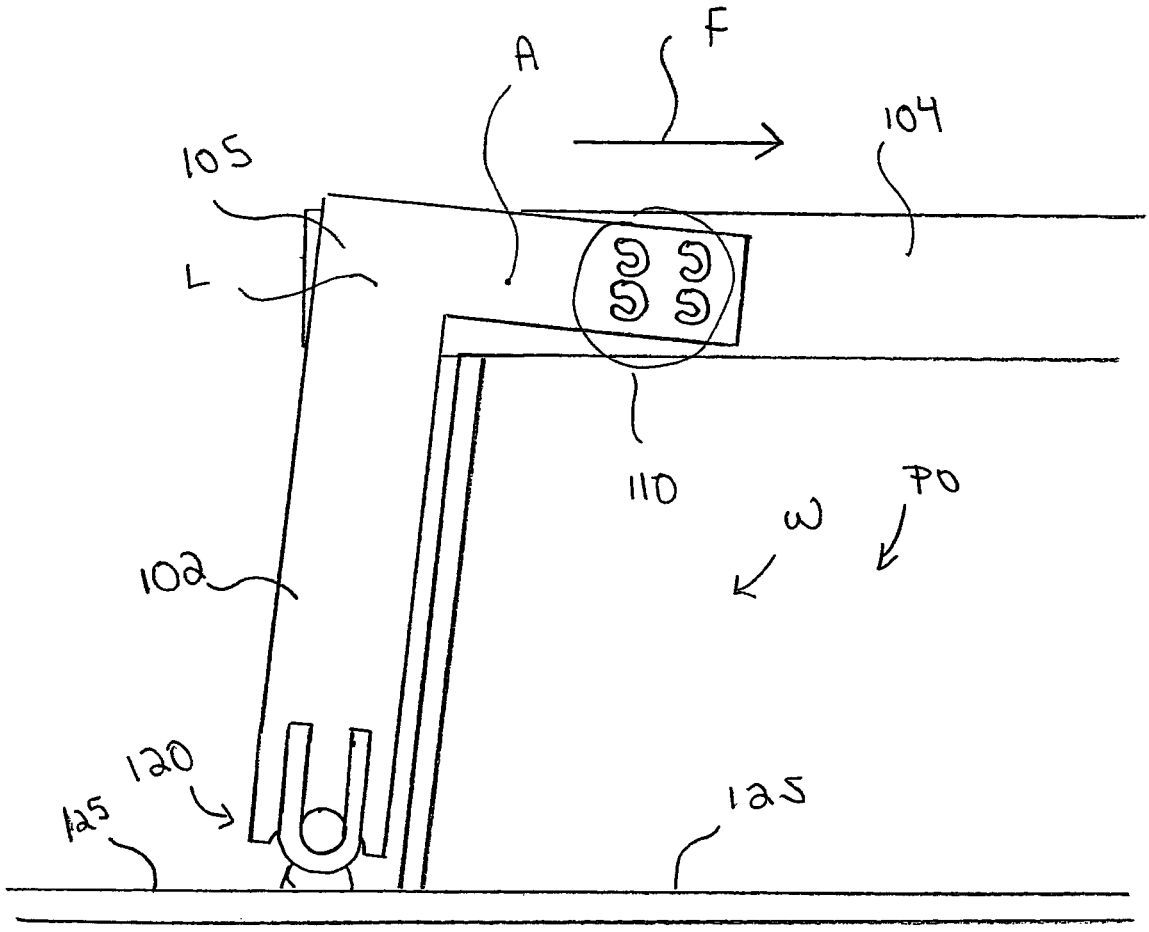
FIG. 3 is a side elevation view of the first embodiment of the invention, not including a pivot joint between the structural members, showing movement of the structural members of the system when a force has been applied thereto.

Alternatively, as can be seen in FIG. 3, the pivot (130 in FIG. 2) need not be included. In this case, active element 110 flexes such that structural members 102 and 104 rotate relative to one another about an axis A that is displaced from joint locus L. By spatially distributing the active elements away from the axis A and away from the locus L, the present invention operates so that stresses between structural members 102 and 104 do not concentrate at the locus L of the joint. The specific location of axis A is defined by the properties of active element 110. Thus, active element 110 is preferably configured to respond to forces applied thereto such that structure 100 exhibits a prescribed load-deflection response when a load has been applied thereto.

In various aspects, the degree to which active element 110 flexes varies along a length of the active element. Moreover, the load-deflection relationship of structure 100 may be nonlinear, and the configuration of active element 110 may change the deflection, velocity or acceleration level of structure 100 in a prescribed manner in response to an applied load. Additionally, active element 110 may be configured to provide stiffness and energy dissipation (when transmitting a force therethrough) via hysteretic damping. The flexure of the active elements dissipates energy regardless of whether the structure is subject to monotonic or oscillatory (i.e. cyclic) loading.

In preferred aspects, the first structural member 102 is generally vertical. In preferred aspects, first structural member 102 may be: a post or a structural member attached to a post; a column, or a structural member attached to a column; a beam, or a structural member attached to a beam; a wall stud, or a structural member attached to a wall stud.

In preferred aspects, the second structural member 104 is generally horizontal. In preferred aspects, second structural member 104 may be: a beam, or a structural member attached to a beam; a wall horizontal plate, or a structural member attached to a wall horizontal plate; a wall sill plate, or a structural member attached to a wall sill plate; a wall header, or a structural member attached to a wall header; a building perimeter frame, or a structural member attached to a building perimeter frame; a rim joist system, or a structural member attached to a rim joist system.

Figure 4:
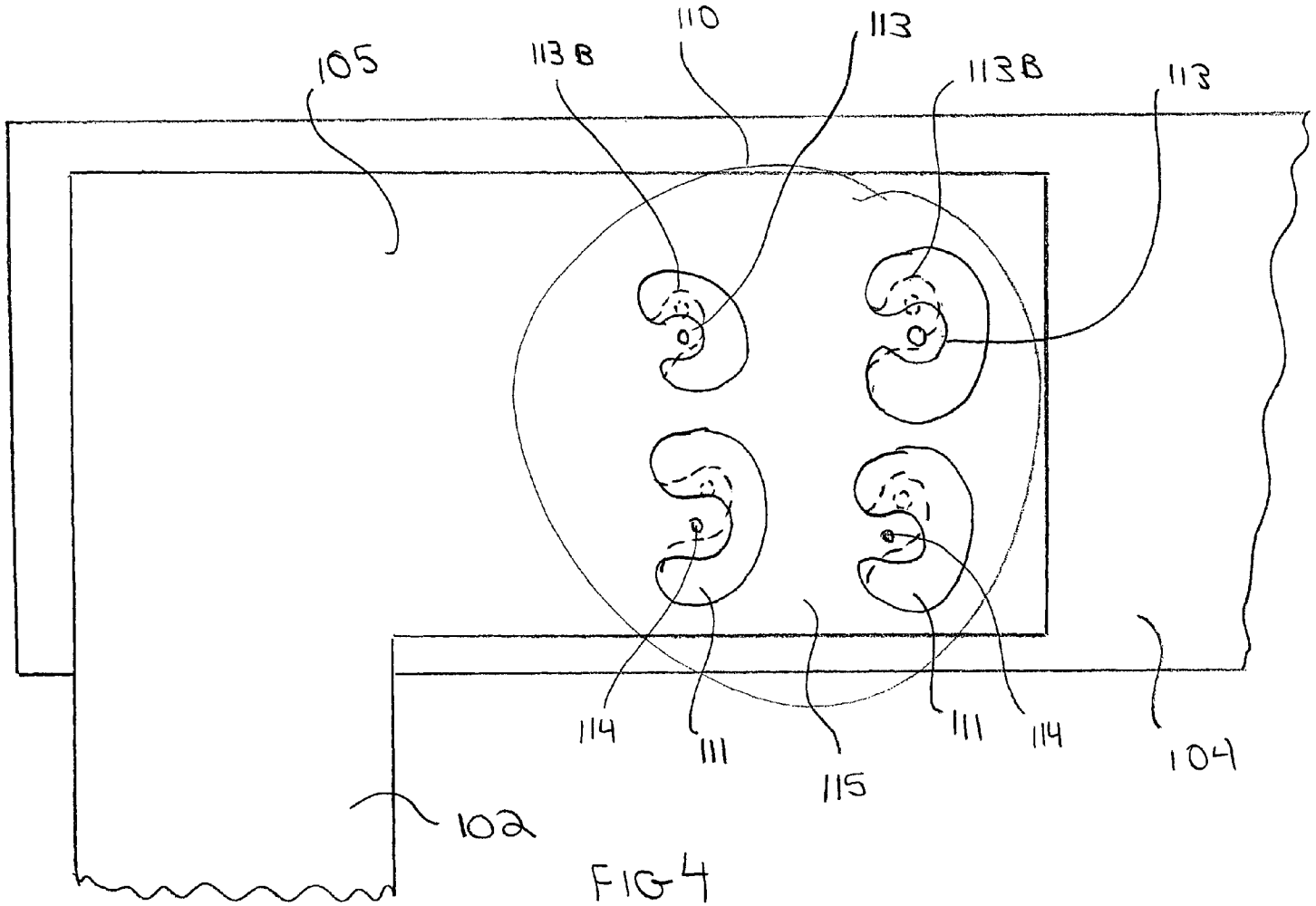
FIG. 4 is a close-up view of the active element of FIG. 1, showing deflection of the active element from a first position to a second position.

FIG. 4 shows a close up of the cut out embodiment of active element 110 seen in FIG. 1. Active element 110 comprises a plurality of cut-out openings 111 within joining element 105. Structural member 104 is connected to a first portion 113 of active element 110 and structural member 102 is connected to a second portion 115 of active element 110. As illustrated in FIG. 4, the first portion 113 is the portion of joining element 105 that is disposed within cut-out opening 111 and second portion 115 is the portion of joining element 105 that is not disposed within cut-out opening 111 (i.e. the remainder of the body of joining element 105). A bolt passing through each of holes 114 is used to fasten header beam 104 to first portion 113 of active element 110. (It is to be understood that screws, lag screws or any other suitable fastener can be used as a substitute for "bolts" as described herein). Additionally, further connectors may be used to connect joining element 105 directly to wall W when wall W covers structure 100. In various aspects, joining element 105 can be fixed rigidly, or through an active element to wall W. Such connectors may optionally comprise a series of connectors connecting the joining element 105 (and/or vertical member 102) to various locations on wall W.

Cut-out openings 111 permit the first and second portions 113 and 115 of active element 110 to move relative to one another. When members 102 and 104 rotate relative to one another from a neutral position to a flexed position, first portions 113 will move to the position shown in dotted lines as 113B.

Figure 5B:
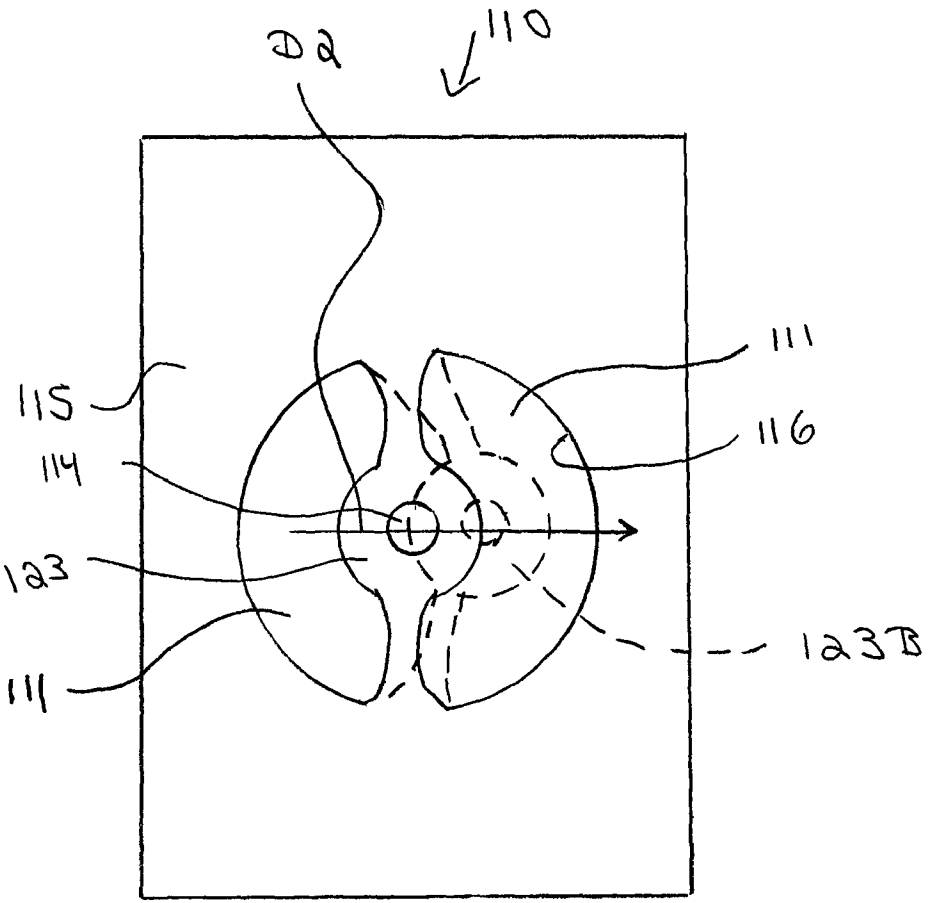
FIG. 5B is a close up of an alternative active element, that can instead be used in the system shown in FIG. 4.
Figure 5A:
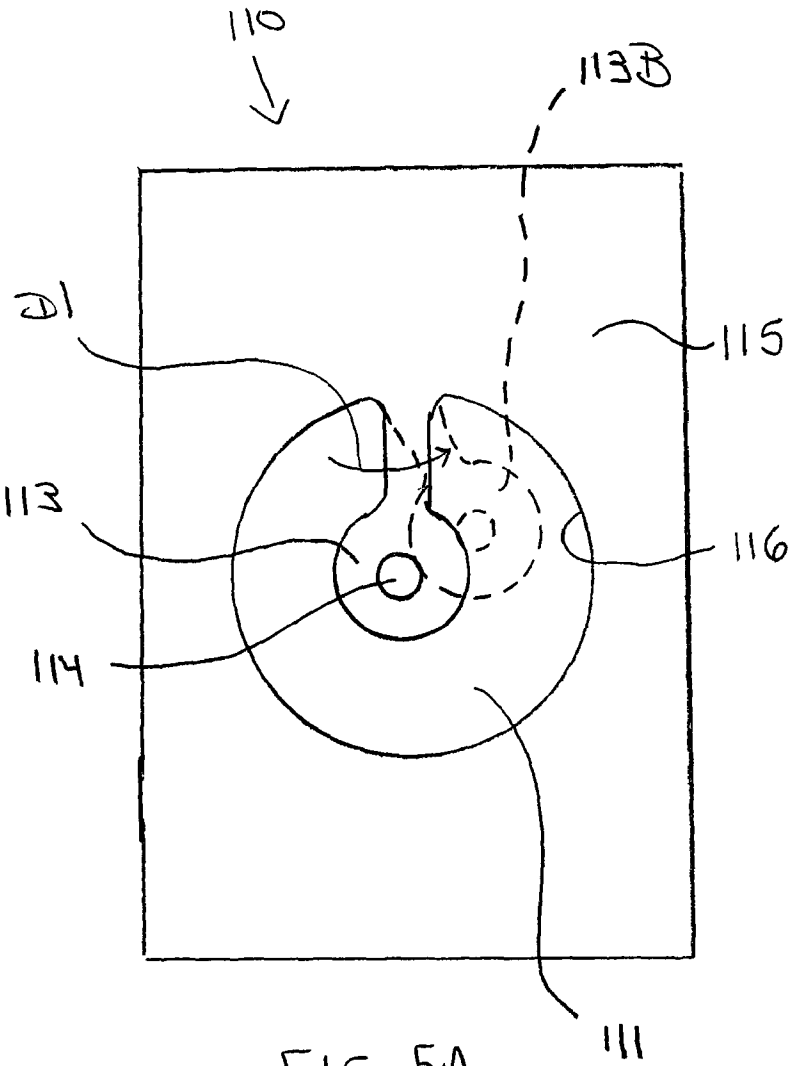
FIG. 5A is a further close up of the active element of FIG. 4.

FIGS. 5A and 5B show alternate cut-out designs of active element 110, as follows. FIG. 5A shows a first cut-out design as was shown in FIG. 4. In this design, the narrow "neck" of first portion 113 first deforms elastically and then plastically as the first portion 113 moves to the location shown as 113B when flexing. Specifically, when active element 110 flexes, first portion 113 will rotate in direction D1 with respect to second portion 115. If pushed (i.e. flexed) far enough, an edge of first portion 113 will eventually contact side edge 116 of opening 111. At this stage, any further deformation of active element 110 will be largely elastic and much stiffer.

Alternatively, FIG. 5B shows a second cut-out design. In this design first portion 113 has two opposite "necks". In this design, the two narrow "necks" of first portion 123 first deform elastically and then plastically (under tension) as first portion 123 moves to the location shown as 123B. When active element 110 flexes, first portion 113 will move in direction D2 with respect to second portion 115. If pushed (i.e. flexed) far enough, an edge of first portion 113 will eventually contact side edge 116 of opening 111. At this stage, any further deformation of active element 110 will be largely elastic and much stiffer.

It is to be understood that active elements 110 as shown in FIGS. 5A and 5B could be subject to tension, bending and compression, or any combinations thereof, depending upon the relative movement of structural members 102 and 104 with respect to one another.

Figure 6:
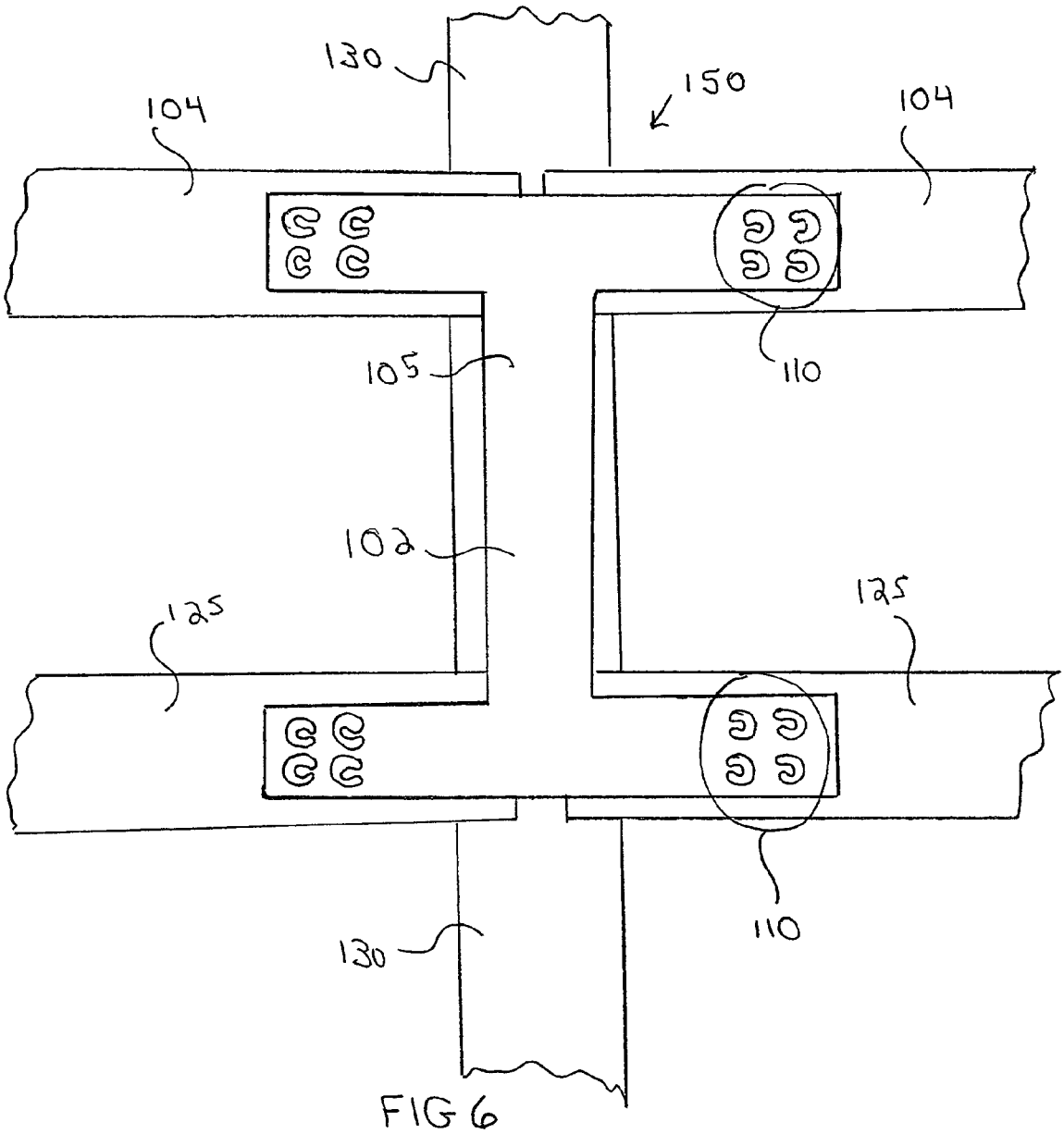
FIG. 6 is a side elevation view of a section of a building incorporating a system of the first embodiment of the present invention having upper and lower active elements.
Figure 7A:
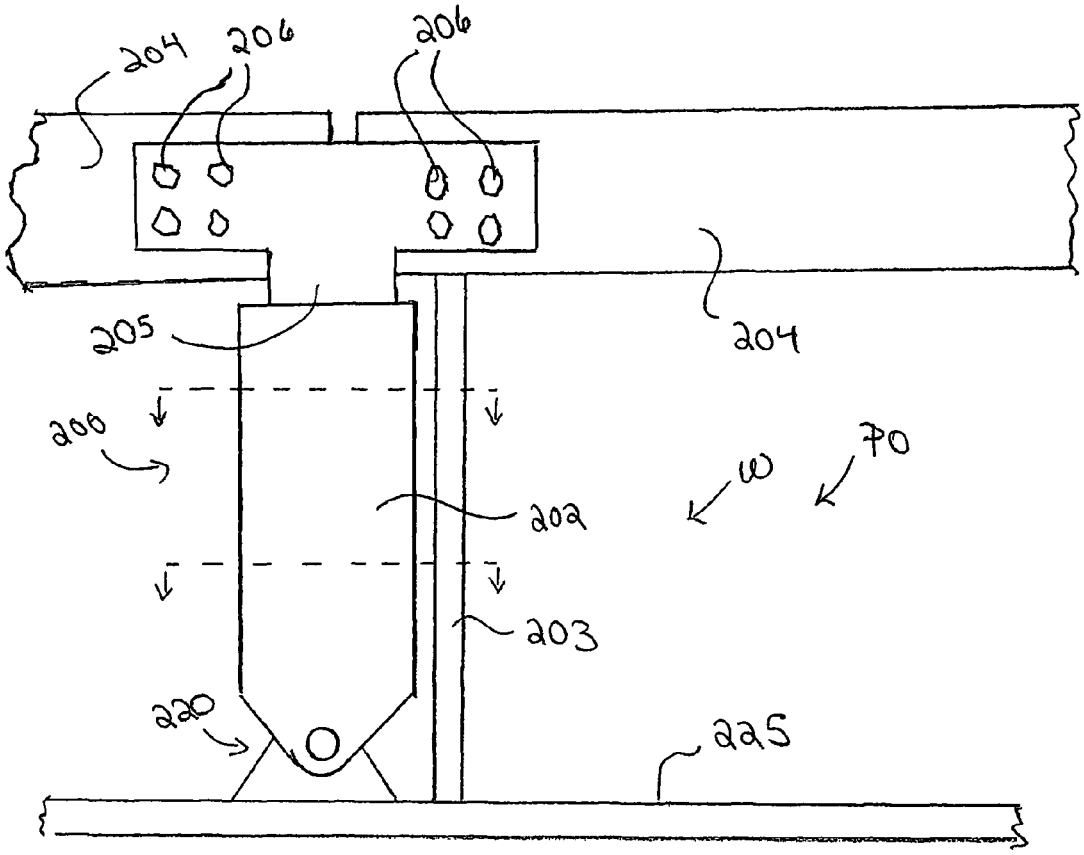
FIG. 7A is a side elevation of a second embodiment of the present invention.
Figure 7B:
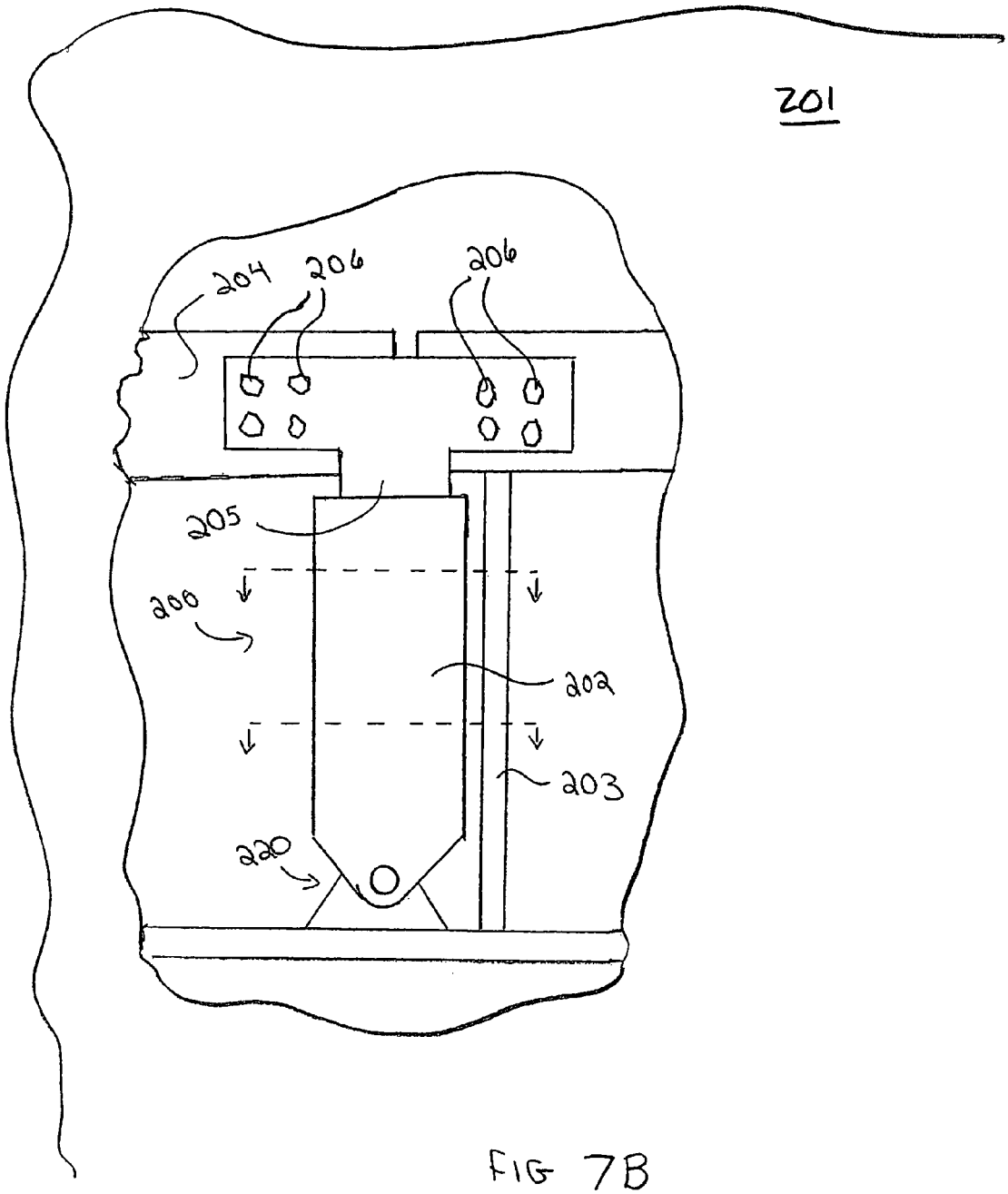
FIG. 7B illustrates the embodiment of FIG. 7A in a wall structure.
Figure 8:
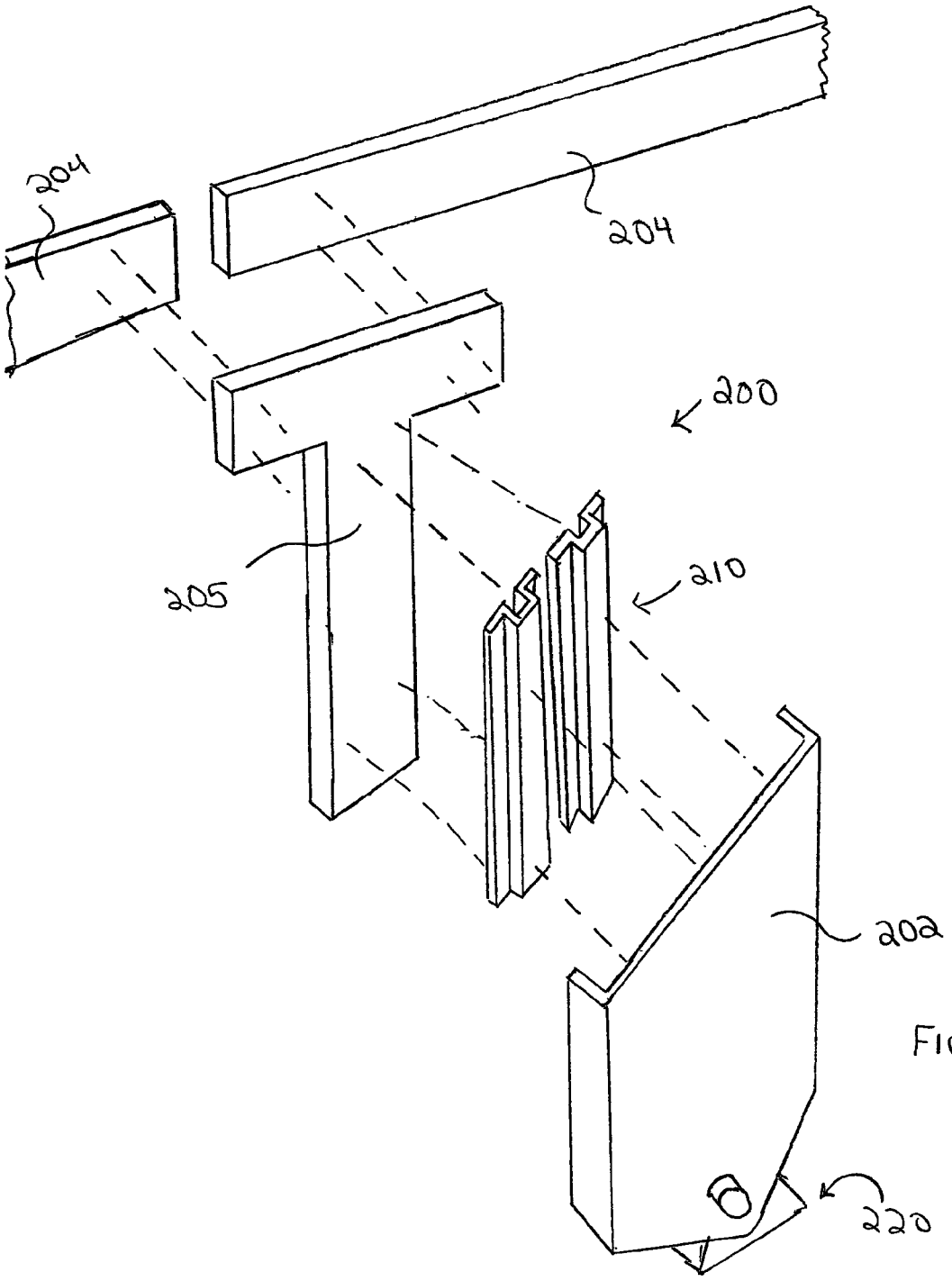
FIG. 8 is an exploded perspective view of the second embodiment of the invention.
Figure 9:
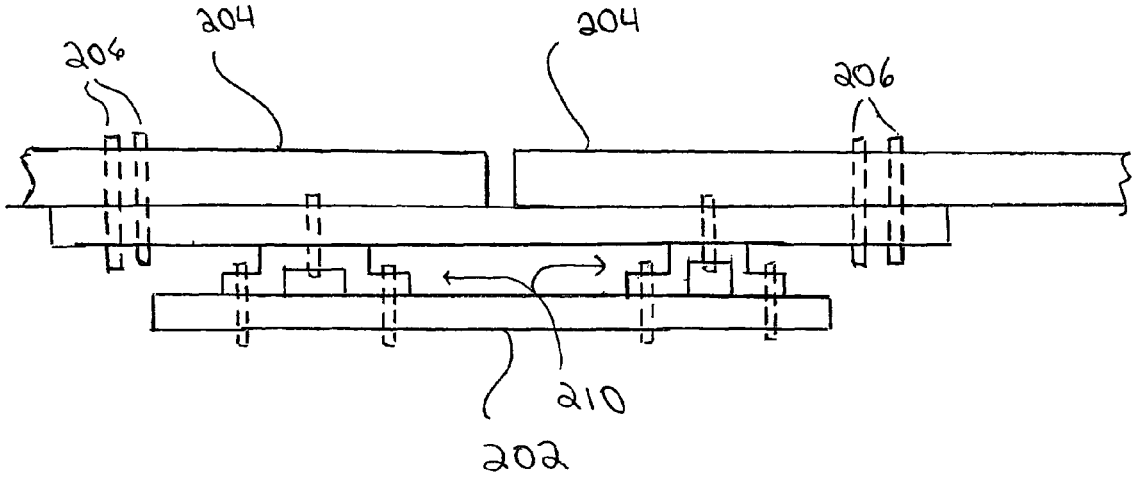
FIG. 9 is a top plan view of the second embodiment of the invention.

FIG. 6 shows a side elevation view of a section of a building incorporating a system of the first embodiment of the present invention having upper and lower active elements 110. Specifically, system 150 comprises two header beams 104 and two building story floor members 125. A vertical building member 130 is also shown. In this illustration, building story members 125 may preferably be located on a second, third, or fourth, etc. story of a building. As such, an additional connector (such as connector 120 in FIG. 1) which is not shown in FIG. 6, may be placed at the bottom of the building, connecting the building to its foundation, in the manner described above.

FIGS. 7 to 14:

FIGS. 7 to 14 illustrate a second embodiment of the present invention, as follows. Referring first to FIG. 7A, a structure 200 is provided. Structure 200 includes at least two structural members. In one aspect, the first structural member is a vertically extending member 202, and the second structural member is one of the header beams 204. As shown, however, two header beams 204 may be used. FIG. 7B illustrates the embodiment of FIG. 7A in a wall structure 201.

Optionally, the first structural member may instead comprise a vertical post or beam 203. It is to be understood that vertically extending member 202 may optionally be attached to beam 203 such that member 202 and beam 203 together comprise the first structural member. It is also to be understood that beam 203 may be omitted such that vertically extending member 202 alone comprises the first structural member.

It is to be understood that structural member 202 may include any of the exemplary members listed above with respect to structural member 102. Similarly, it is to be understood that structural member 204 may include any of the exemplary members listed above with respect to structural member 104.

Structure 200 includes a joining element 205 that is connected to structural members 202 (or 202/203 together) and 204. As illustrated clearly in FIG. 8, joining element 205 may be T-shaped. Header beam 204 may be made of wood, laminated veneer lumber (lvl), pressed steel or any other suitable structural material to which joining element 205 may be attached.

An active element 210 is provided. As will be explained, active element 210 may comprise one or more bendable sections or channels of material connected to joining element 205. As such, active element 210 is disposed between joining element 205 and vertical member (e.g. vertical channel) 202.

Active element 210 is configured such that when a force applied to one structural member (e.g. to header beam 204) the force passes at least partially through active element 210 and into the other structural member (e.g. vertical member 202), such that the entire structure 200 exhibits a prescribed load-deflection relationship.

A connector 220 configured to connect vertical member 202 to an external body is provided. As shown, connector 220 may comprise a pivot joint or a live hinge joint operating in the same manner as was described above with reference to connector 120 in FIG. 1. As such, connector 220 permits movement of structural members 202 and 204 without transmitting substantial bending moments to an external body 225. (External body 225 may comprise a portion of any floor of a building or the foundation of the building, similar to external body 125.) Thus, structural members 202 and 204 are permitted to rotate relative to one another while connector 220 prevents, or very substantially reduces, bending moment transmission to floor/foundation 225 in the plane in which structural members 202 and 204 are disposed.

Active element 210 is configured in a manner similar to that described above with reference to active element 110. Thus, structure 200 may alternatively be disposed in adjacent to (or fully within) a wall W or portal opening PO, operating in the same manner as was described above with reference to structure 100. For example, active element 210 may be configured such that the entire building structure (into which structure 200 is incorporated) exhibits a desired load-deflection relationship when a force is applied to the building.

Joining element 205 is preferably rigidly connected to header beam 204 such that joining element 205 does not move with respect to header beam 204. Such connection may be made by a series of bolts 206. Further details of this bolted (or screw or otherwise fastened) connection are shown in the top view of FIG. 9.

Figure 10:
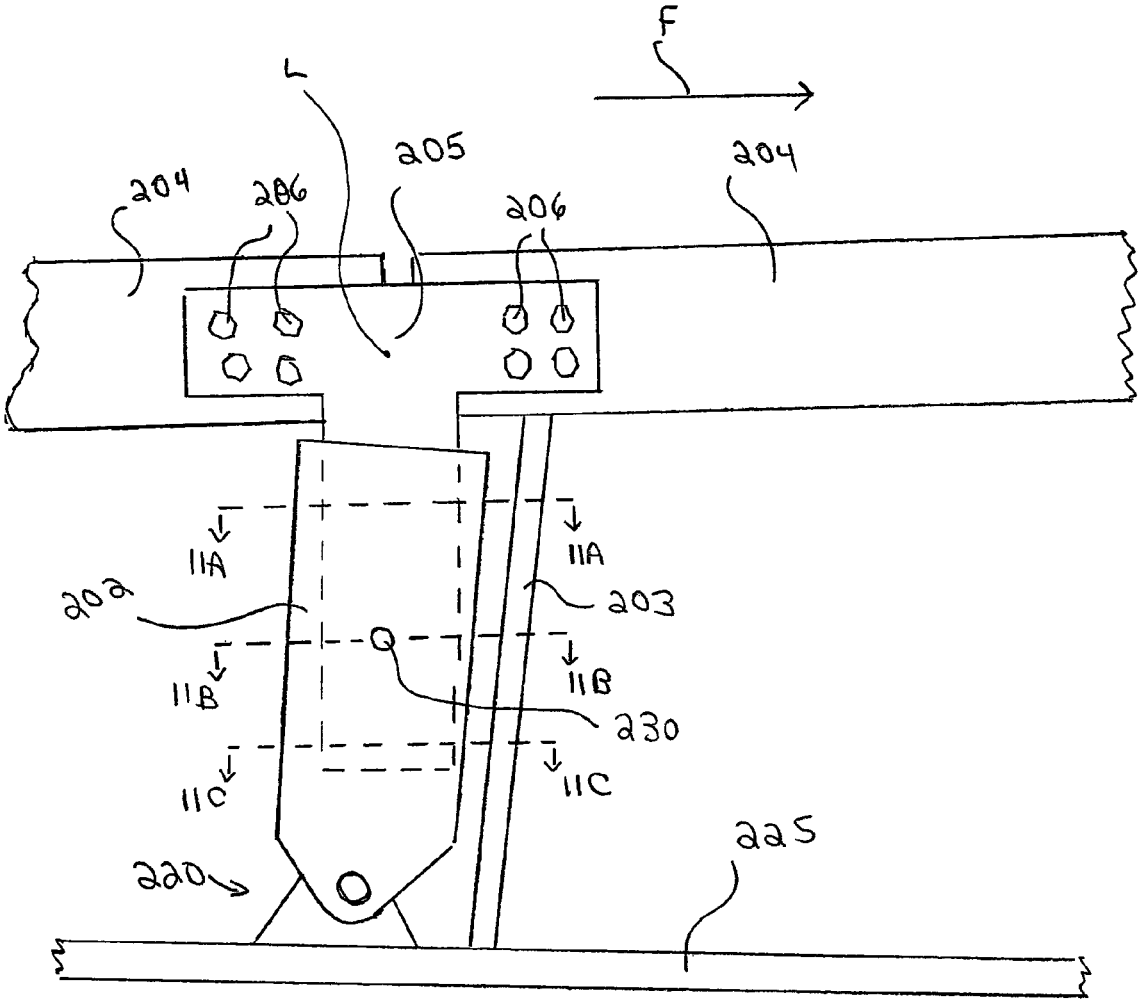
FIG. 10 is a side elevation view of the second embodiment of the invention, further including a pivot joint between the structural members, showing movement of the structural members of the system when a force has been applied thereto.

As can be seen in FIG. 10, an optional pivot 230 can be provided between joining element 205 and vertical member 202. When a force F is applied along header beam 204, header beam 204 (together with joining element 205) and vertical member 202 will rotate relative to each other about pivot 230.

As will be explained below, active element 210 will preferably flex when this rotation occurs. This is shown most clearly in FIGS. 11A to 11C discussed below. By flexing, active element 210 operates so that stresses between structural members 202 and 204 do not concentrate between the structural members at their joint locus L. Instead, the stresses are shared by active element 210 flexing. Moreover, pivot 230 also assists in providing support to horizontal header beam 204. In this aspect of the invention, active element 210 is located some distance away from the joint locus L between structural members 202 and 204. When a plurality of active elements 210 re used, they may be spatially distributed at locations away from joint locus L.

Figure 11B:
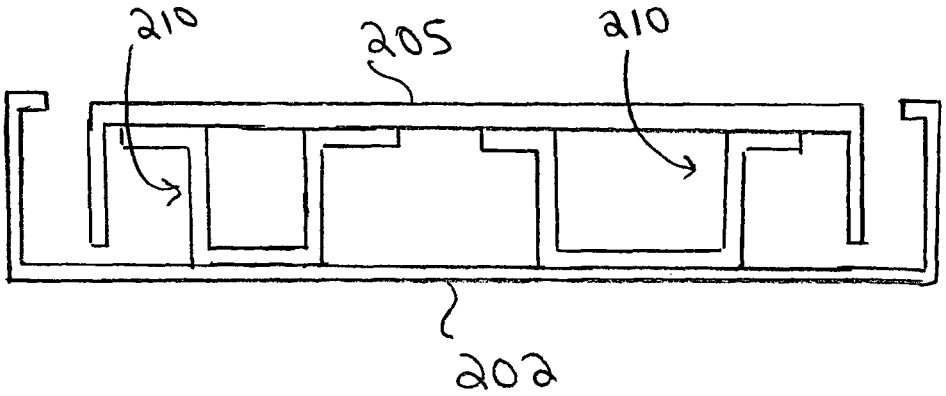
FIG. 11B is a top sectional top plan view taken along line 11B-11B in FIG. 10.
Figure 11A:
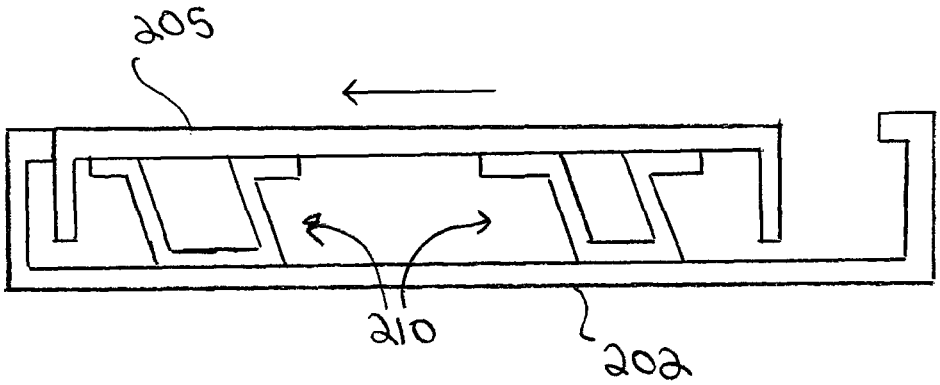
FIG. 11A is a top sectional top plan view taken along line 11A-11A in FIG. 10.
Figure 11C:
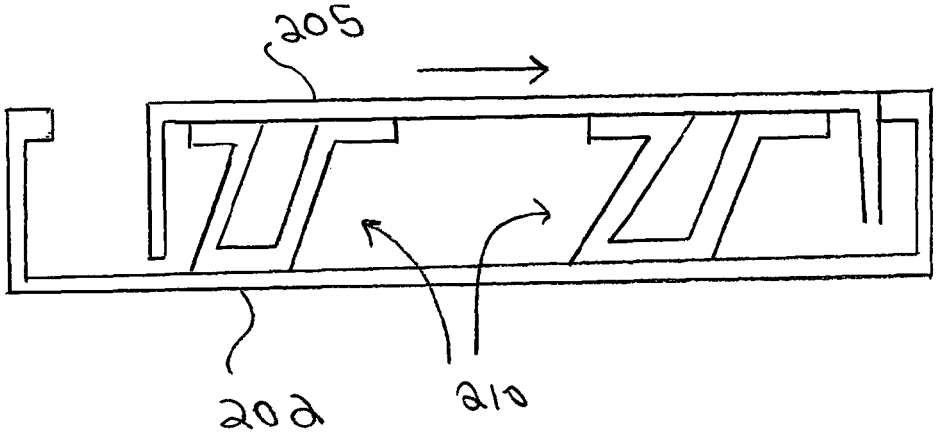
FIG. 11C is a top sectional top plan view taken along line 11C-11C in FIG. 10.

FIGS. 11A, 11B and 11C show further details of the flexing of active element(s) 210 taken along the lines 11A-11A, 11B-11B and 11C-11C in FIG. 10, respectively, as follows. Each active element 210 comprises a vertically extending channel of bendable or foldable material. Most preferably, this material is metal. The present inventors have successfully modeled a joining element 205 having a width of 11.25 inches and a depth of about 2 inches, together with a vertical member 202 having a width of 14.5 inches and a depth of 2.5 inches, with both joining element 205 and vertical member 202 being fabricated from 13 gage mild steel. Additionally, each active element 210 was modeled with a height of 2.5 inches and were fabricated from 12 gage steel. The resulting system, as illustrated in FIG. 11, was sufficient to meet code requirements equivalent to a 22 inch pre-manufactured wood shear wall (being typical in the building industry). Moreover, by slightly increasing the thickness of the metal in active elements 210, or by slightly increasing the width of vertical structural member 202, the present system can be used at a portal opening to provide the same shear resistance characteristics as a solid conventional ply shearwall, without any weakening from the portal opening itself.

FIG. 11A shows the bending of active elements 210 near the top of vertical member 202. Specifically, shear forces on active element 210 (caused by relative movement of structural members 202 and 204) cause active element 210 to bend. FIG. 11B shows a view corresponding to that passing through pivot 230. As such, there is no bending of active element 210 at this location. FIG. 11C shows the bending of active elements 210 near the bottom of vertical member 202. Note that FIGS. 11B and 11C show active element 210 bending in opposite directions. By flexing in different directions along their length, active elements 210 transmit, absorb and dissipate energy due to structure 200 exhibiting a prescribed force/deflection relationship when a force is applied thereto. In this way, active element 210 reacts to bending moments between structural members 202 and 204 such that the unwanted effects of these bending moments are substantially reduced.

Figure 12:
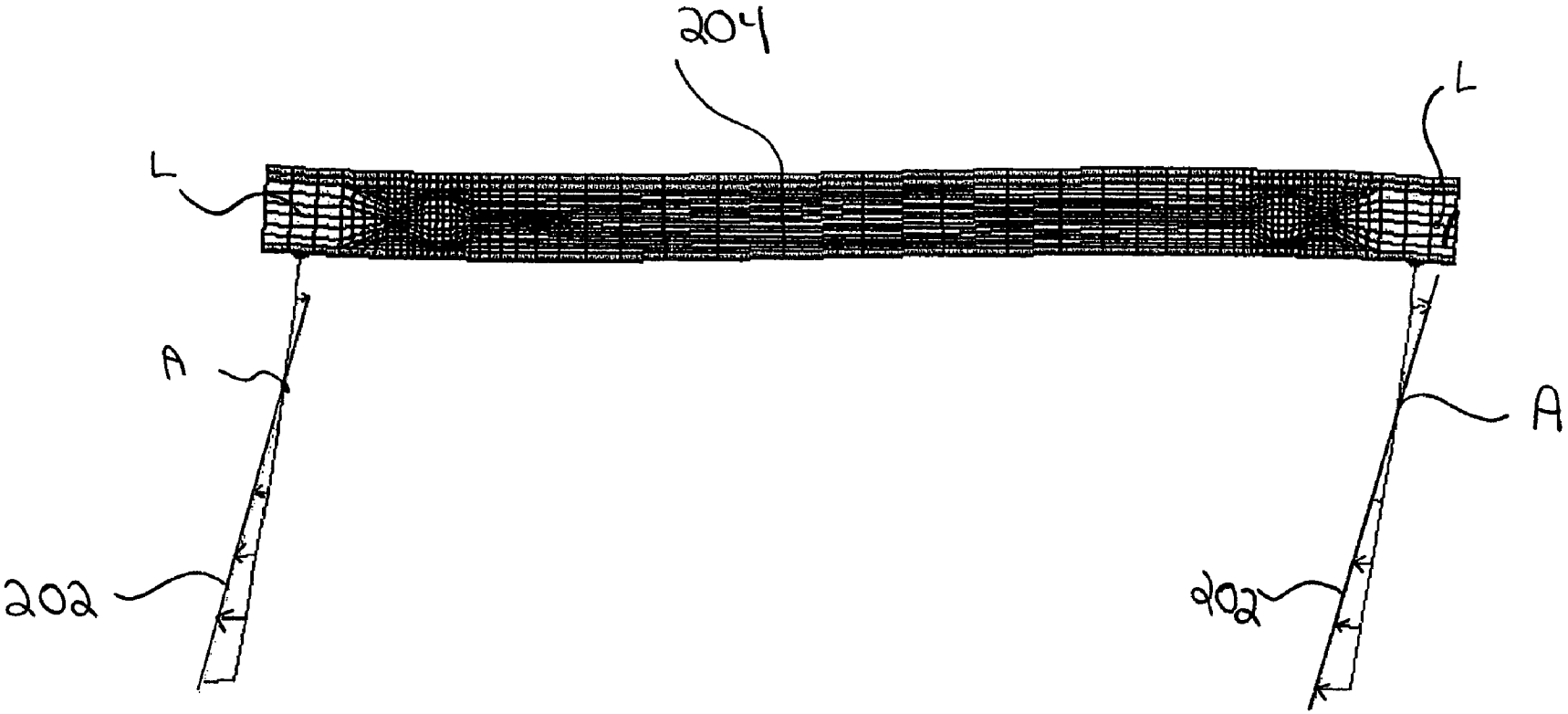
FIG. 12 is an illustration of the movement of the structural members of the second embodiment of the invention when a pivot joint is not provided between the first and second structural members.

It is to be understood that pivot 230 is optional. FIG. 12 shows relative movement of a pair of vertically extending members 202 and a header beam 204 in the absence of a pivot 230. As can be seen, each pair of structural members 202 and 204 rotate about an axis A that is displaced from its joint locus L. By thus moving axis A (about which structural members 202 and 204 rotate) to a location displaced away from joint locus L, the present invention operates so that stresses between structural members 202 and 204 do not concentrate at the locus L of the joint. Rather, the effective length of the bending moment arm of vertical member 202 is reduced and the unwanted effects of bending moments at joint loci L are thereby substantially reduced. The specific location of axis A is defined by the properties and location of active element 210. Thus, active element 210 is preferably configured to respond to forces applied thereto such that structure 200 exhibits a prescribed load-deflection response when a load has been applied thereto.

In the aspect of the invention illustrated in FIG. 12 (i.e.: in the absence of a pivot joint 230), the full weight of header beams 204 is supported through active elements 210. This could possibly prove to be disadvantageous in that the ability of active elements 210 to support such weight could change as, or after, the active element 210 flexes. Specifically, since active element 210 comprises a vertically extending "hat-shaped" channel of material, its stiffness is diminished after it has been bent to one side at its top end and bent to an opposite side at its bottom end.

Figure 13:
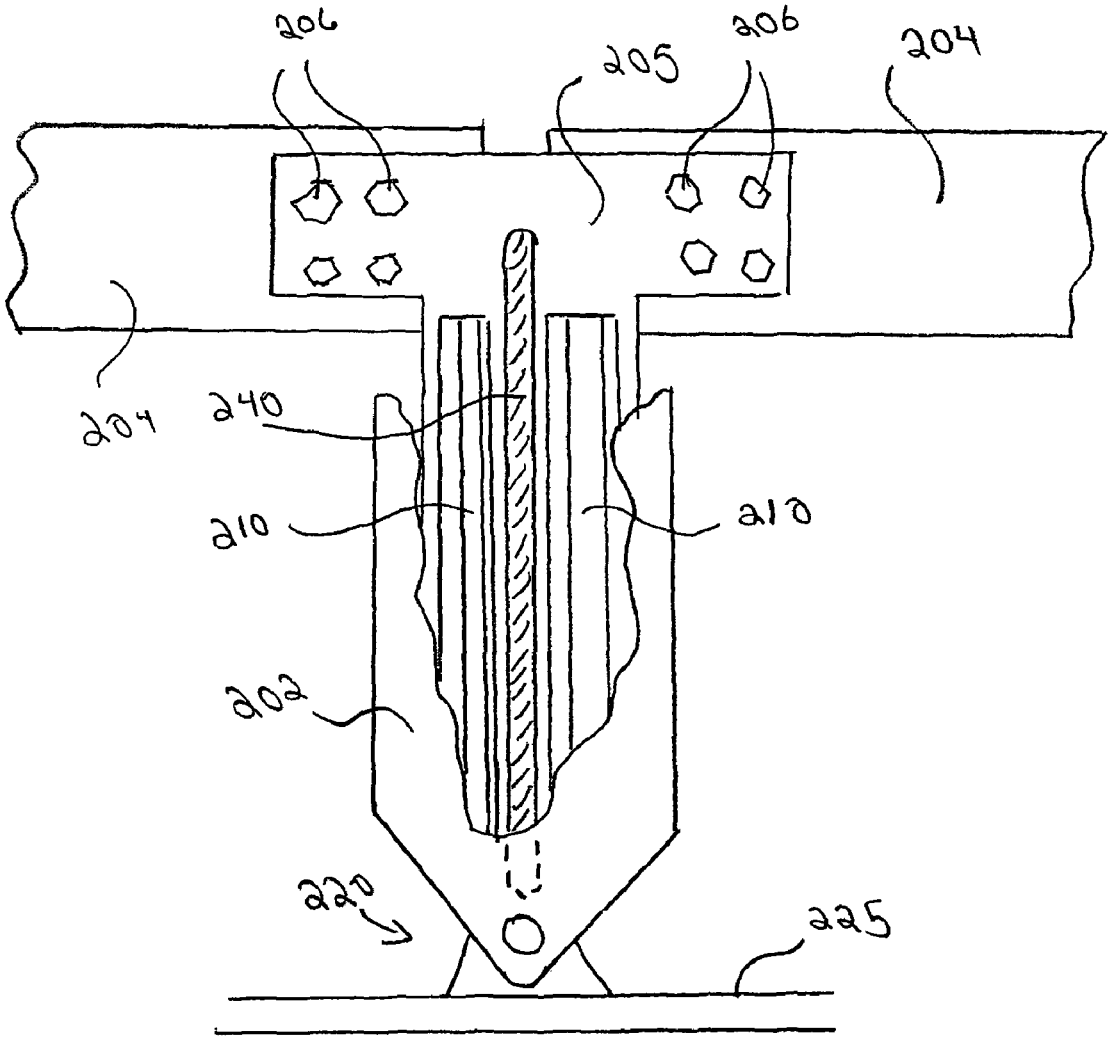
FIG. 13 is a cut-away side elevation view of the second embodiment of the invention, further including a load bearing element partially supporting the weight of one of the structural members.

For this reason, an optional aspect of the invention includes a load bearing element 240 (FIG. 13). Load bearing element 240 is configured to at least partially support the weight of one of the two structural members (e.g. header beams 204), such that its weight is not fully supported by the active element(s) 210. As shown, load bearing element 240 may comprise a cable connecting joining element 205 to vertical structural member 202. The use of a cable as the load bearing element 240 has the advantage that such cable would move slightly from side to side as joining element 205 moves with respect to vertical member 202 as active element(s) 210 flex. Alternatively, when pivot joint 230 is present, pivot 230 advantageously acts as the load bearing element, by connecting joining element 205 to vertical member 202.

Figure 14:
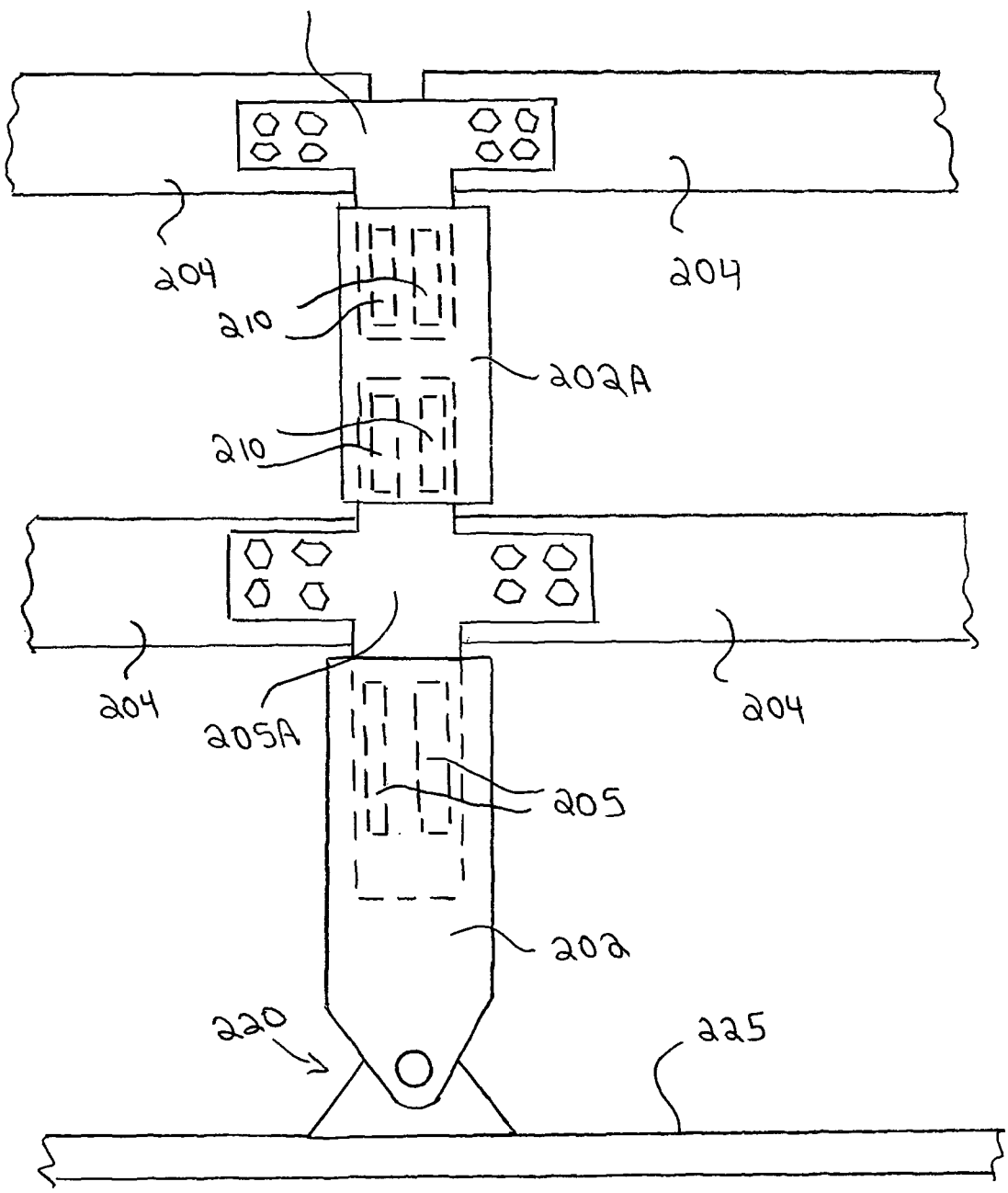
FIG. 14 is a side elevation view of a section of a building incorporating a system of the second embodiment of the present invention having upper and lower active elements.

FIG. 14 shows a side elevation view of a section of a building incorporating a system of the second embodiment of the present invention. In this aspect of the invention, the lower joining element 205A is cross-shaped and is connected to active elements 210 at both its upper and lower ends. In addition, upper vertical member 202A is connected to active elements 210 at both its upper and lower ends. A connector 220, as described above is provided at the bottom of the system, operating in the manner described above.

FIGS. 15 and 16:

FIGS. 15 and 16 illustrate a third embodiment of the present invention, as follows. Referring first to FIG. 15, a structure 300 is provided. Structure 300 includes at least two structural members. In one aspect, the first structural member is a vertically extending post 302, and the second structural member is a portion of a rim joist 304. Post 302 is preferably anchored in a building foundation 303 which sits on top of, or within, the ground G.

Structure 300 includes a joining element 305 which connects post 302 to rim joist 304. Further details of joining element 305 are seen in the top plan view of FIG. 16. In the illustrated embodiment, joining element 305 comprises an outer frame 320 and an inner frame 330. A first pair of active elements 310A are disposed between outer frame 320 and inner frame 330. A second pair of active elements 310B are disposed between inner frame 330 and post 302. Active elements 310 may comprise one or more bendable sections or channels of material similar in shape to the "hat-shaped" active elements 210 described above. Active elements similar to cylindrical active elements 510 (see FIGS. 19 to 23) but instead positioned with their longitudinal axes being vertical, may also be substituted for active elements 310. Active elements 310 are configured such that when a force applied to one structural member (e.g. a seismic load moving post 302 horizontally in one or more directions) the force passes at least partially through active elements 310 and into the other structural member (e.g. rim joist 304), such that the entire structure 300 exhibits a prescribed load-deflection relationship in response to loading.

As can be seen in FIG. 16, when post 302 moves back and forth in direction D1, active elements 310A will flex back and forth in direction D1. Similarly, when post 302 moves back and forth in direction D2, active elements 310B will flex back and forth indirection D2. Thus, the present invention reduces the effects of force loading in the horizontal plane of the rim joist 304. Additionally, since active elements 310 comprise vertically extending channels of material, as shown, active elements 310 may also flex so as to reduce the unwanted effects of bending moments between post 302 and rim joist 304. Specifically, active elements 310A will flex so as to reduce the unwanted effects of bending moment BM1 (FIG. 15), and active elements 310B will flex so as to reduce the unwanted effects of bending moment BM2 (FIG. 16). To accomplish this, each of active elements 310A and 310B would flex in a manner similar to that described with reference to active elements 210, above. Specifically, the top end of the active element 310 would flex in one direction and the bottom end of the active element 310 would flex in an opposite direction. Thus, structure 300 reduces the unwanted effects of bending moments in various vertically extending planes passing through post 302.

Active elements 310 are preferably configured in a manner similar to that described above with reference to active elements 110 and 210. Thus, structure 300 may also alternatively be disposed under a wall or portal opening, operating in the same manner as was described above with reference to structure 100. For example, active element 310 may be configured such that the entire building structure (into which structure 300 is incorporated) exhibits a desired load-deflection relationship when a force is applied to the building.

FIGS. 17 and 18:

FIG. 17 is a perspective view of a wall stud and sill plate sitting on a floor joist hanger according to the present invention. FIG. 18 is a perspective view similar to FIG. 17, incorporating a wall stud and sill plate according to the present invention.

Referring first to FIG. 17, structure 400 includes a wall (or shear panel 401) attached to a standard vertical stud 402 and a standard sill plate 404. The entire structure 400 is resting on a concrete foundation 411 and the ground G. A rim joist 407 (including a joist hanger 417) is shown supporting a floor joist 408 and sub floor 409 under sill plate 404. Rim joist 407 includes an active element 410 (similar to active element 431 described below). Active element 410 permits relative movement of assembly 401/402/404/408/409 relative to foundation 411 in direction D3 (being the same direction as D3 in FIG. 18). A separation layer 413 is provided between joist hanger 407 and foundation 411 to absorb the relative motion between joist hanger 407 and foundation 411. Separation layer 413 may be made of plastic, or any other material having a suitable coefficient of friction. As can also be seen, rim joist 407 is preferably channel shaped such that it is further able to deform to absorb vertical loads from wall assembly 410/402/404. Joist hanger 417 provides vertical stiffness to the c-shaped channel of rim joist 407. Thus, rim joist 407 and joist hanger 409 is also able to react to bending moments in direction BM1 (i.e. around an axis extending in direction D3).

FIG. 18 illustrates an embodiment of the present invention including a wall stud and a sill plate according to the present invention. A wall stud 420 and a sill plate 430 according to the present invention are provided. As will be explained, wall stud 420 can advantageously be substituted for a standard stud 402 in FIG. 17 to provide beneficial shear resistance properties (i.e. load-deflection behavior) in wall (or shear panel) 401. Similarly, sill plate 430 can advantageously be substituted for a standard sill plate 404 in FIG. 17 to provide beneficial shear resistance properties (i.e. load-deflection behavior) in wall (or shear panel) 401.

Specifically, wall stud 420 preferably has a series of cut out sections 421 disposed along its edge, as shown. Cut out sections 421 permit link sections 422 (interspersed between cut out sections 421) to flex such that side 423 may move in direction D1 while side 424 moves in direction D2. Wall 401 is preferably attached to side 423. Accordingly, any toppling movement of wall stud 420 would not fully translate into a bending moment applied to wall 401. An optional shear membrane (e.g.: plywood) may be attached to wall stud 420 and a sill plate 430 and to any other structural members containing active elements such that any force on the wall is absorbed, transmitted or dissipated by active elements 422 and 432.

In addition, sill plate 430 preferably comprises a bendable section or channel of material, which is preferably made of metal. As can be seen, a cut out active element 431 may be provided. (Active element 431 being the same design as the active element 110 shown in FIG. 5B). Active element 431 permits sill plate 430 to be bolted (or otherwise suitably fastened) to sub floor 409 and to react to loading in direction D3. In an optional design of sill plate 430, a small horizontal ledge 432 divides wall sections 433 and 434. Ledge 432 is preferably configured to flex such that wall section 434 may move up and down in direction D4. As such, sill plate 430 is also adapted to react to toppling movement of wall stud 420 in a direction normal to the plane of wall (or shear panel) 401.

Although wall stud 420 and sill plate 430 are shown in use with a wall 401, it is to be understood that wall stud 420 and a sill plate 430 can also be beneficially used even in the absence of a wall 401. For example, they can be used to reinforce a portal opening.

Thus, in FIGS. 17 and 18, a structure 400 is provided having at least two structural members. These structural members may comprise the wall stud 402/420 and sill plate 404/430, or the wall 401 and sub floor 409, or any combination thereof. These structural members are joined together by at least one active element (410 or 421/422 or 431 or 432) wherein a force applied to one structural member passes at least partially through the active element and into the other structural member, with the active element being configured such that the structure exhibits a prescribed load-deflection relationship when a force is applied thereto.

Figure 19:
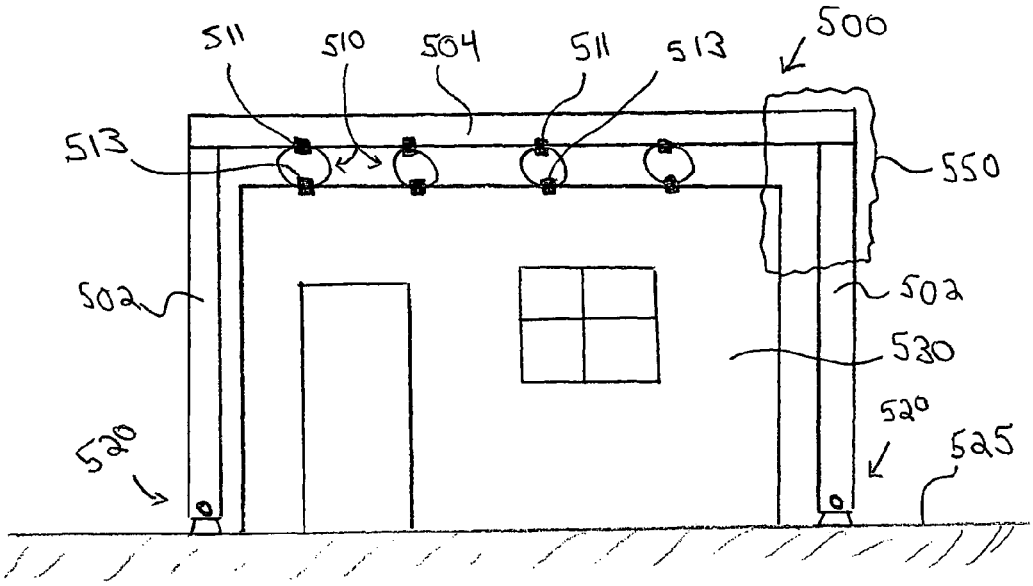
FIG. 19 is a side elevation view of a fourth embodiment of the present invention.

FIGS. 19 to 23:

FIGS. 19 to 23 illustrate a fourth embodiment of the present invention, as follows. Referring first to FIG. 19, a structure 500 is provided. Structure 500 includes a header beam 504 and a pair of vertical members 502. In different aspects of the invention, the top ends of vertical members 502 may be connected to header beam 504 by any traditional means, or by pivot joints, or by a system shown in structure 100 or 200 or 400, described above. Vertical members 502 are preferably connected to an external body such as floor/foundation 525 by a pair of connectors 520 (operating similar to connectors 120 or 220 described above).

A series of active elements 510 are provided. As illustrated in further detail in FIG. 21, active elements 510 preferably each comprise a hollow cylinder of material. Header beam 504 is preferably connected to one side of active element 510 by fastener 511, and wall 530 is preferably connected to an opposite side of active element 510 by fastener 513.

Figure 20:
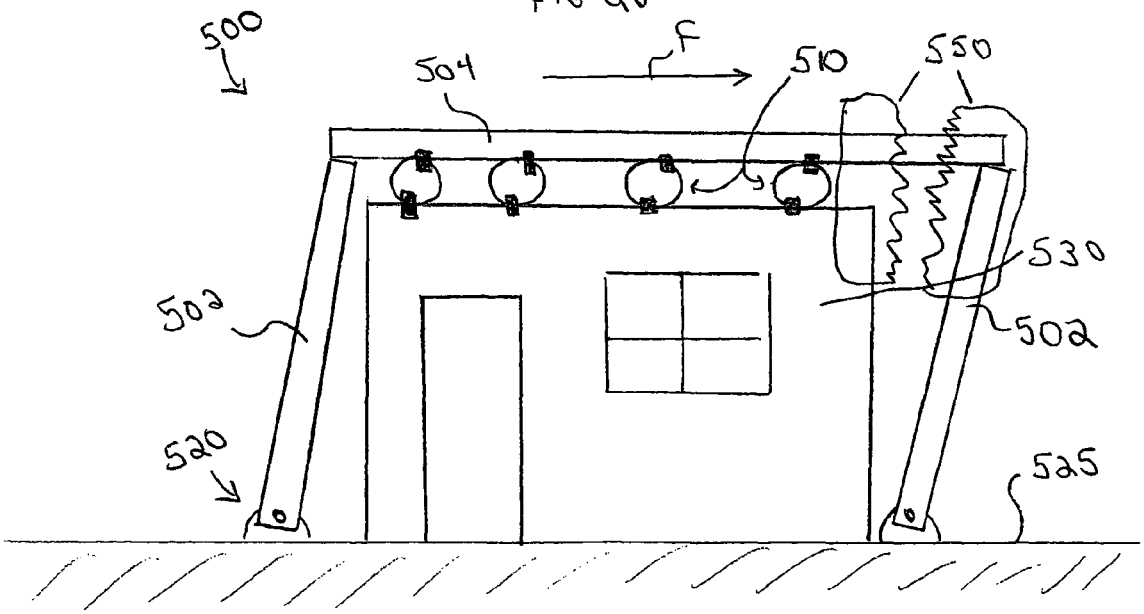
FIG. 20 is a side elevation view of the fourth embodiment of the present invention, showing movement of the structural members of the system when a force has been applied thereto.

Referring next to FIG. 20, active elements 510 are configured such that when a force F is applied to header beam 504, the active elements 510 will flex by rotating slightly, as shown. This flexing can be seen more clearly by referring to FIG. 22 (which shows a close up view of active elements 510 in the position shown in FIG. 19) as compared to FIG. 23 (which shows a close up view of active elements 510 in the position shown in FIG. 20).

Active elements 510 are particularly advantageous in that they flex to substantially reduce the unwanted effects of shear and bending moments in wall 530. In effect, they isolate wall 530 from bending forces and stresses traveling through vertical members 502 and horizontal building member 504.

However, a further advantage of the design of active elements 510 is that it is configured to transmit large forces in a direction along the axis of the cylinder (by resisting relative movement of header 504 and wall 530 along the direction of the axis), while transmitting much smaller forces (between header 504 and wall 530) in a direction normal to the axis of the cylinder. This is accomplished by permitting "rolling" movement in the direction normal to the axis. This advantage can be seen in FIG. 21, where a wind loading force in direction F2 (i.e.: normal to wall 530) is applied to the wall. Substantially all of this force F2 will be transmitted in (the same) direction D1 to wall 530. This is particularly advantageous in that the overall structure retains its stiffness in a direction normal to the wall, and is thus able to withstand wind loading against the wall. Other element configurations that similarly have high stiffness in selected directions and low stiffness in other selected directions are usable.

In a manner similar to that described above, active element 510 is preferably configured such that when a force (F in FIG. 21) is applied to one structural member (e.g. header beam 504 or wall 530) the force passes at least partially through active element 510 and into the other structural member (i.e. the other of header beam 504 or wall 530), such that the entire structure 500 exhibits a prescribed load-deflection relationship.

Figure 21:
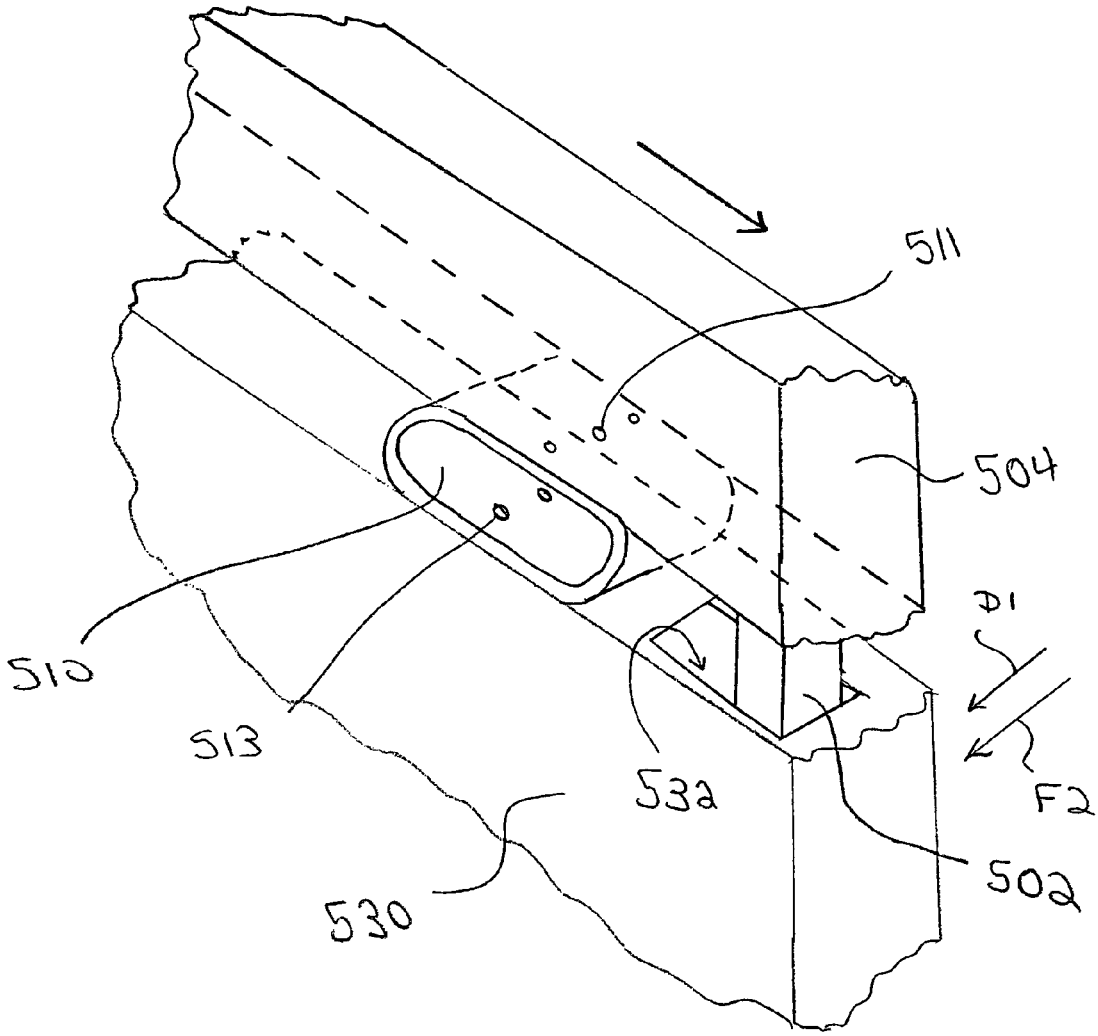
FIG. 21 is a cut away perspective view of the fourth embodiment of the invention.
Figure 22:
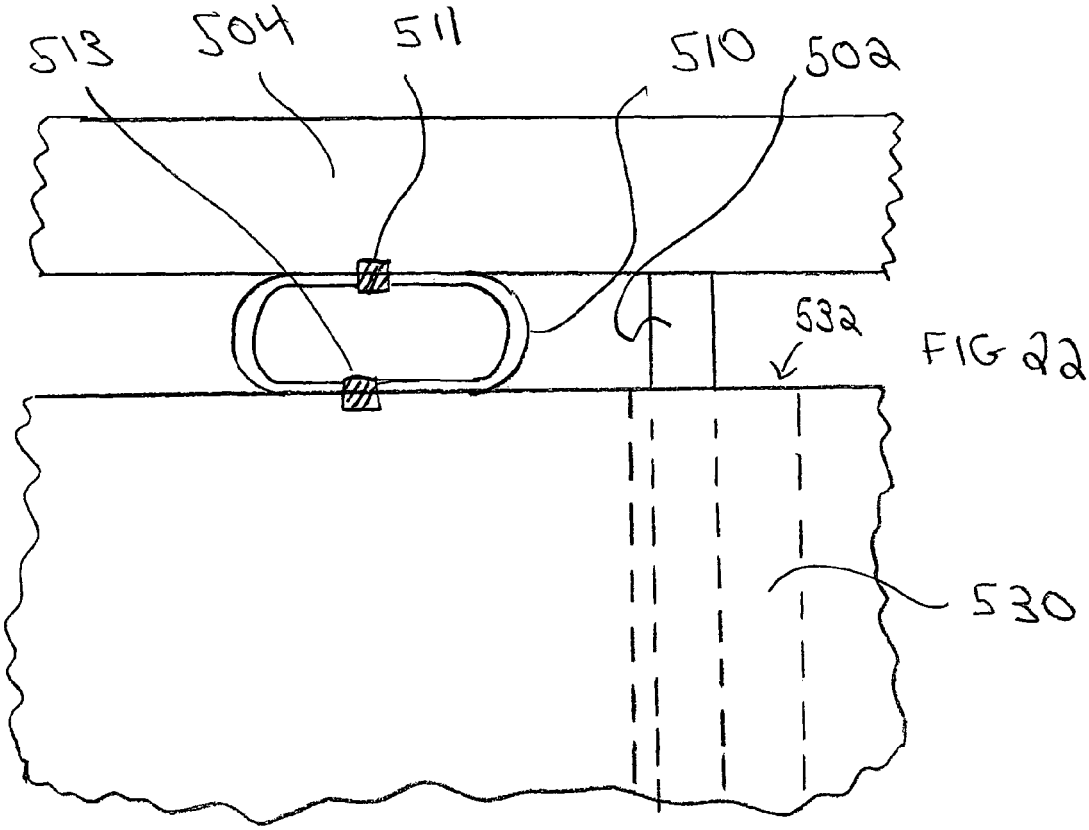
FIG. 22 is a close up side elevation view of the active element in the position shown in FIG. 19.
Figure 23:
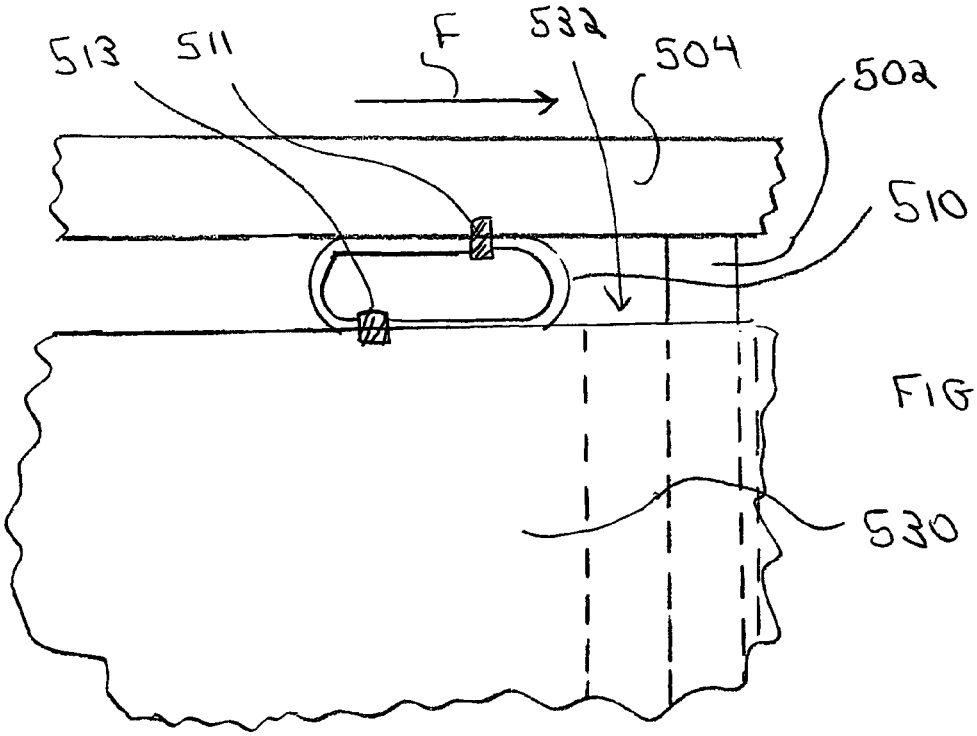
FIG. 23 is a close up side elevation view of the active element in the position shown in FIG. 20.

As illustrated in FIGS. 21 to 23, vertical structural member 502 may optionally comprise an intermediate load bearing post in a wall. Preferably, vertically extending intermediate load bearing posts 502 are isolated from wall 530 via vertically extending apertures 532 in the wall. Thus, load bearing post 502 is able to move somewhat within aperture 532 without transmitting bending or shear loads to wall 530.

In optional preferred aspects, covering elements 550 are attached to the structural members such that gaps among the structural members are covered. Such covering elements 550 may be disposed around the entire perimeter of wall 530, being connected to either or both of structural members 502 and 504. For ease of illustration, only a small portion of covering element 550 is shown in FIGS. 19 and 20 (being in a corner between wall 530 and structural members 502 and 504.

Covering elements 550 cover the gaps between wall 530 and structural members 502 and 504. Thus, they permit relative motion among the structural members with respect to one another. Preferably, covering elements 550 are sacrificial elements which may break apart with large loading or motion (as shown in FIG. 20).

FIGS. 24 and 25:

FIGS. 24 and 25 illustrate an alternate design for an active element according to the present invention. Active element 610 comprises a bendable channel of material (similar to active elements 210, described above). In addition, however, active element 610 further comprises folds 602 on either side. One structural member is attached to the bottom of active element 610, whereas another structural (or joining) member 620 is connected to the top of active element 610.

An advantage of active element 610 is that it flexes such that members 620 and 630 can be moved with respect to one another in any of six degrees of freedom (absorbing forces in all six degrees of freedom), as desired. Referring to FIG. 25, members 620 and 630 can be moved in perpendicular directions D1, D2 and D3 with respect to one another, or they may be rotated in perpendicular directions D3, D4 ad D5 with respect to one another. As such movement occurs, the 605 sides will bend with respect to top 607 and bottom 609 of the active element 610. In addition, each of side folds 602 may open (e.g. fold 602B) or close (e.g. fold 602A). Moreover, folds 602 may tend to spread apart at one end and be compressed together at an opposite end along the length of the active element 610.

A particular advantage of active element 610 is that the same spacing between structural members 620 and 630 can be maintained even with the structural members moving laterally in direction D1 or rotating in direction D3 with respect to one another.

It is to be understood that active element 610 may be substituted for any of the active elements including 110, 210, 310, 430 or 510 described above.

FIG. 26:

FIG. 26 illustrates an optional add-on system 600 which may be used to actively control stiffness and energy dissipation. System 600 is illustrated for use with structure 100 (of FIG. 1) but is not so limited. Rather, system 600 can be used with any embodiment of the invention. In one optional aspect, system 600 may comprise an actuator 602 and a sensor 604. Actuator 602 may be mounted on top of structural member 104, as shown. Actuator 602 may further include a rod 603 which moves with respect to the mounted body of actuator 602. Sensor 604 detects the motion of rod 603 as active elements 110 flex. When motion is detected (especially cyclic motion at undesirable frequencies), actuator 602 may be activated such that it provides additional resistance to the movement of rod 603. This may have the advantageous effect of varying the energy dissipation characteristics of active elements 110.

It is to be understood that system 600 is not limited to the described embodiment. Rather, it may include any electrical or mechanical system which actively or passively modifies the load-deflection relationship of the structure in response to motion, either by modifying the characteristics of the active elements or by augmenting the load-deflection characteristics of the active elements. As such, system 600 may include any add-on system that responds to building movement, forces or acceleration wherein the system actively or passively adds or subtracts forces from the active elements, thus modifying the energy dissipation properties of the active elements.

FIGS. 27 and 28:

Advantages of the present system are shown schematically by comparing FIGS. 27 and 28. FIG. 27 illustrates a pair of Simpson StrongWalls® 700 disposed on either side of a portal opening PO. The StrongWalls® 700 are each connected to header beam 104 at their top ends, as shown. When a force F (which may include a seismic loading force) is applied along header 104, bending moments will be created in each of StrongWalls® 700 such that one side is under tension (forces FT), and the opposite side is under compression (Forces FC). Each StrongWall® 700 has a height of H700 and a width of W700. As can be seen, StrongWall® 700 has a high aspect ratio (i.e.: its height H700 is significantly greater than its width W700). The bending moments caused by force F thus result in significant overturning forces in each StrongWall® 700. This is due to the fact that the overturning moments must be resolved into forces over the relatively narrow width W700.

Further disadvantages of StrongWalls® 700 include the fact that they tend to separate from header 104 at locations 701; separate from the ground or foundation members at locations 702; and compress at locations 703. Thus, a variety of external connectors (anchoring the StrongWall® 700 to the foundation and to the header beam 104), are required. A cumbersome assortment of internal reinforcements are found in each StrongWall® 700 as well.

FIG. 28 illustrates the advantages of the present invention over the Simpson StrongWall® design. FIG. 28 illustrates a pair of vertical members 102 disposed on either side of a portal opening PO. Vertical members 102 are each connected to header beam 104 at their top ends through active elements 110 (or any other active elements), as shown. When a force F (which may include a seismic loading force) is applied along header 104, vertical members 102 will rotate about connectors 120. Thus, no substantial bending moments will be transmitted from each of vertical members 102 to the ground or foundation members. Thus, the bending moment in structure 100 is advantageously resolved over the entire system width W100 (which is much larger than width W700 in FIG. 27), thus reducing the unwanted effects of the bending moment on the overall structure.

It will be noted that the active elements 110 of the present invention effectively displace the point about which structural members 102 and 104 rotate relative to one another from the locus of the joint therebetween. This beneficially reduces the local loads on header 104 (as compared to overturning moments on a conventional narrow shear wall (such as the Simpson StrongWall® 700 in FIG. 27). While header 104 must still transmit all of the loads, they are now better distributed therein. Moreover, as the pivot joint (i.e. connector 120) does not transmit significant bending loads, the foundation loads are greatly decreased (especially the uplift and compression loads associated with the hold down bolts of the conventional high aspect ratio StrongWall® 700 shear wall). This reduction in loads is sufficient to allow much lighter and cheaper anchor bolts and still meet the code mandated pull out requirements and spacing from the edge of the foundation. Requirements for grade beams across garage portals can also be reduced proportionate to the reduction in local bending and uplift such as occur with shear and moment frame portal solutions.

What is claimed is:

1. A structure, comprising:

at least two structural members;

a joining element connected to the at least two structural members; and at least one active element within the joining element, or between the joining element and at least one of the structural members, wherein a force applied to one structural member passes at least partially through the active element and into the other structural member, the active element being configured such that the structure exhibits a prescribed load-deflection relationship when a force is applied thereto, wherein the prescribed load-deflection relationship includes energy dissipation from cyclically repeatable hysteretic plastic flexing of the at least one active element.

2. The structure of claim 1, wherein one of the structural members is incorporated into the joining element.

3. The structure of claim 1, further comprising:

a connector configured to connect at least one of the structural members to an external body.

4. The structure of claim 3, wherein connector is configured to connect the at least one structural member to the external body without transmitting substantial bending moments to the external body in a plane in which the structural members are disposed.

5. The structure of claim 4, wherein the connector is configured to connect the at least one structural member to the external body so as to transmit substantial bending moments to the external body in a plane other than the plane in which the structural members are disposed.

6. The structure of claim 3, wherein the connector is configured to connect the at least one structural member to the external body without transmitting substantial bending moments to the external body in a plane in which the structural members are disposed, and to transmit substantial bending moments to the external body in a plane perpendicular to the plane in which the structural members are disposed.

7. The structure of claim 3, wherein the external body is a fixed wall base.

8. The structure of claim 7, wherein the structure is configured to be disposed within a load bearing wall.

9. The structure of claim 8, wherein active element is configured such that the load bearing wall exhibits a desired load-deflection relationship when a force is applied to the load bearing wall.

10. The structure of claim 3, wherein the external body is a ground plane member of a building story.

11. The structure of claim 10, wherein the structure is configured to be disposed within a load bearing wall.

12. The structure of claim 11, wherein active element is configured such that the load bearing wall exhibits a desired load-deflection relationship when a force is applied to the load bearing wall.

13. The structure of claim 3, wherein the structure is configured to be disposed within a wall and to reinforce the wall.

14. The structure of claim 13, wherein active element is configured such that the wall exhibits a desired load-deflection relationship when a force is applied to the wall.

15. The structure of claim 14, wherein the connector is further configured to connect the joining element to the wall.

16. The structure of claim 1, wherein the structure is configured to be disposed adjacent to a portal opening and to reinforce the portal opening.

17. The structure of claim 16, wherein active element is configured such that structural members adjacent to the portal opening exhibit desired load-deflection relationships when a force is applied to the structural members adjacent to the portal opening.

18. The structure of claim 17, wherein the connector is further configured to connect the joining element to at least one of the structural members adjacent to the portal opening.

19. The structure of claim 1, wherein the structure is configured to be disposed within a building, and wherein active element is configured such that the building exhibits a desired load-deflection relationship when a force is applied to the building.

20. The structure of claim 1, wherein the active element transmits, absorbs and dissipates energy due to the active element exhibiting a prescribed force/deflection relationship when subject to cyclic motion.

21. The structure of claim 1, wherein the active element is configured to react to a bending moment between the first and second structural members in a plane in which both the first and second structural members are disposed.

22. The structure of claim 21, wherein the active element is configured to transmit, absorb and dissipate energy resulting from the relative motion of the first and second structural members.

23. The structure of claim 21, wherein the first and second structural members are disposed in a wall, and wherein the plane in which both the first and second structural members are disposed is the plane of the wall.

24. The structure of claim 21, wherein the first and second structural members are disposed adjacent to a portal opening, and wherein the plane in which both the first and second structural members is disposed is the plane of the portal opening.

25. The structure of claim 21, wherein the first structural member is a post extending vertically from a building foundation, and the second structural member is a portion of a rim joist extending horizontally, and wherein the plane in which both the first and second structural members are disposed is vertical.

26. The structure of claim 1, wherein the active element is configured by performing finite element analysis.

27. The structure of claim 1, wherein the active element is configured by performing iterative calculations.

28. The structure of claim 1, wherein the active element is integrally formed into the joining element.

29. The structure of claim 1, wherein the active element is positioned away from a locus of the joint formed between the first and second structural members.

30. The structure of claim 29, wherein the active element comprises a plurality of active elements distributed at locations away from the locus of the joint.

31. The structure of claim 1, wherein the active element is configured such that the first and second structural members rotate relative to one another about an axis displaced from the locus of the joint formed between the first and second structural members.

32. The structure of claim 31, wherein the active element is configured such that stresses between the first and second structural members do not concentrate at the locus of the joint.

33. The structure of claim 1, wherein the active element flexes when a force passes therethrough, and wherein the degree to which the active element flexes varies along a length of the active element.

34. The structure of claim 1, wherein the joining element and active element are configured such that the structural members rotate relative to one another about an axis of rotation when the active element flexes.

35. The structure of claim 34, further comprising:

a pivot disposed on the joining element, wherein the axis of rotation passes through the pivot.

36. The structure of claim 1, wherein the load-deflection relationship of the structure is nonlinear.

37. The structure of claim 1, wherein the load-deflection relationship of the active element in the structure changes the deflection, velocity or acceleration level of the structure in a prescribed manner in response to an applied load.

38. The structure of claim 1, wherein the active element is configured to provide stiffness and energy dissipation.

39. The structure of claim 38, wherein the stiffness and energy dissipation of the active element is effected passively or controlled mechanically to modify the load-deflection relationship of the structure in response to motion.

40. The structure of claim 38, wherein the stiffness and energy dissipation of the active element is controlled electrically to modify the load-deflection relationship of the structure in response to motion.

41. The joining element of claim 1, further comprising:

a load bearing element at least partially supporting the weight of one of the two structural members, such that the weight of the one of the two structural members is not fully supported by the active element.

42. The structure of claim 41, wherein the load bearing element comprises a cable connecting the joining element to one of the structural members.

43. The structure of claim 41, wherein the load bearing element comprises a pivot on the joining element connecting the joining element to one of the structural members.

44. The structure of claim 1, wherein at least one of the structural members is an intermediate load bearing post in a wall, the post being isolated from the wall via vertically extending apertures in the wall.

45. The structure of claim 44, where in at least one of the structural members is an intermediate load bearing post in a wall, the post being isolated from the wall via vertically extending apertures in the wall.

46. The structure of claim 1, wherein the active element comprises a member having a plurality of cut-out sections therein.

47. The structure of claim 46, wherein the first structural member is connected to a first portion of the active element and the second structural member is connected to a second portion of the active element, and wherein the cut-out sections permit the first and second portions of the active element to move with respect to one another when the active element flexes.

48. The structure of claim 47, wherein the active element comprises a body with a section cut out forming a bendable portion disposed within a hole, and wherein one of the structural members is connected to the bendable portion, and the other structural member is not connected to the bendable portion.

49. The structure of claim 1, wherein the active element has high stiffness and force resistance in selected directions and low stiffness and force resistance in other selected directions.

50. The structure of claim 49, wherein the active element is a hollow cylinder.

51. The structure of claim 50, wherein the first and second structural members are connected to different locations on the hollow cylinder.

52. The structure of claim 50, wherein the active element is configured to transmit larger forces in a direction along the axis of the cylinder, and smaller forces in a direction normal to the axis of the cylinder.

53. The structure of claim 50, wherein the active element is configured to resist movement in a direction along the axis of the cylinder, and to permit movement in a direction normal to the axis of the cylinder.

54. The structure of claim 1, wherein the active element is a bendable folded channel of material.

55. The structure of claim 54, wherein the material is metal.

56. The structure of claim 54, wherein the bendable folded channel of material is dimensioned such that a fold therein spreads apart at one end and is compressed together at an opposite end when the first and second portions of the joining element rotate with respect to one another.

57. The structure of claim 1, wherein the active element is a hollow rectangular or channel shaped element having a plurality of slots disposed therealong.

58. The structure of claim 57, wherein the slots are disposed along the corners of the active element.

59. The structure of claim 57, wherein the slots are disposed along the edges of the active element.

60. The structure of claim 59, wherein the joining element is a metal wall stud, and wherein the active element is formed by at least one slot disposed in the joining element.

61. The structure of claim 1, wherein the joining element is a joist hanger.

62. The structure of claim 61, wherein the joist hanger has an open channel cross section and a cut out active element therein.

63. The structure of claim 1, further comprising:

covering elements attached to the structural members such that gaps among the structural members are covered.

64. The structure of claim 63, wherein the gaps permit relative motion among the structural members with respect to one another.

65. The structure of claim 63, wherein the covering elements are sacrificial elements.

66. The structure of claim 1, wherein the prescribed load-deflection relationship includes hysteretic elastic behavior.

67. The structure of claim 1, wherein the joining element includes at least two rigid sections.

68. A method of configuring a structure to exhibit a prescribed load-deflection relationship when a force is applied thereto, comprising:

joining at least two structural members with a joining element having at least one active element therein, the active element at least partially passing a force therethrough, wherein the active element is configured such that the structure exhibits a prescribed load-deflection relationship when a force is applied thereto, and wherein the prescribed load-deflection relationship includes energy dissipation from cyclically repeatable hysteretic plastic flexing of the at least one active element.

69. The method of claim 68, further comprising connecting at least one structural member to an external body without transmitting substantial bending moments thereto in one or more directions.

70. The method of claim 68, wherein the force is passed though the active element such that the two structural members rotate relative to each other about a point away from a locus of the joint formed between the two structural members.

71. The method of claim 68, wherein the force is passed though the active element such that the active element transmits, absorbs and dissipates energy resulting from the relative movement of the first and second structural members.

72. The method of claim 68, wherein the prescribed load-deflection relationship includes hysteretic elastic behavior.

73. The method of claim 68, wherein the joining element includes at least two rigid sections.

74. The method of claim 68, wherein the structure is configured to be disposed within a load bearing wall.

75. The method of claim 68, wherein the first and second structural members are disposed in a wall, and wherein the plane in which both the first and second structural members are disposed is the plane of the wall.

76. The method of claim 68, wherein the first and second structural members are disposed adjacent to a portal opening, and wherein the plane in which both the first and second structural members is disposed is the plane of the portal opening.

* * * * *